US010064493B2

(12) United States Patent
Machael et al.

(10) Patent No.: US 10,064,493 B2
(45) Date of Patent: Sep. 4, 2018

(54) FLEX LUMBAR SUPPORT

(71) Applicant: HNI Technologies Inc., Muscatine, IA (US)

(72) Inventors: Jay R. Machael, Muscatine, IA (US); Jesse Hahn, Cedar Rapids, IA (US); Travis J. Crowell, Davenport, IA (US); Bruce Fifield, Milan (IT)

(73) Assignee: HNI Technologies Inc., Muscatine, IA (US)

( * ) Notice: Subject to any disclaimer, the term of this patent is extended or adjusted under 35 U.S.C. 154(b) by 435 days.

(21) Appl. No.: 14/684,921

(22) Filed: Apr. 13, 2015

(65) Prior Publication Data

US 2015/0296989 A1 Oct. 22, 2015

Related U.S. Application Data

(60) Provisional application No. 61/981,060, filed on Apr. 17, 2014.

(51) Int. Cl.

| | |
|---|---|
| ***A47C 7/46*** | (2006.01) |
| ***A47C 7/44*** | (2006.01) |
| *A47C 1/032* | (2006.01) |

(52) U.S. Cl.

CPC ..... *A47C 7/46* (2013.01); *A47C 7/44* (2013.01); *A47C 7/462* (2013.01); *A47C 1/03255* (2013.01)

(58) Field of Classification Search

CPC ..... A47C 1/03255; A47C 7/44; A47C 7/46; A47C 7/462; B60N 2/66; B60N 2/666; B60N 2/667

USPC ..... 297/284.4, 284.7

See application file for complete search history.

(56) References Cited

U.S. PATENT DOCUMENTS

| | | | |
|---|---|---|---|
| 186,462 | A | 1/1877 | Clay |
| 909,751 | A | 1/1909 | Butcher et al. |
| 1,290,532 | A | 1/1919 | Fischer |
| 1,376,382 | A | 4/1921 | Horine |
| 2,312,030 | A | 2/1943 | Cramer et al. |
| 2,471,024 | A | 5/1949 | Cramer |
| 2,796,920 | A | 6/1957 | Cowles |
| 3,102,753 | A | 9/1963 | Schliephacke |
| 3,258,259 | A | 6/1966 | Nils |

(Continued)

FOREIGN PATENT DOCUMENTS

| | | | |
|---|---|---|---|
| BS | 1302 | S | 2/2015 |
| CN | ZL2014303935083 | S | 6/2015 |

(Continued)

OTHER PUBLICATIONS

"Contessa Task" by Teknion, copyright 2003-2004, downloaded from http://www.teknion.com/products/seating, 2 pages.

(Continued)

*Primary Examiner* — Ryan D Kwiecinski

(74) *Attorney, Agent, or Firm* — Faegre Baker Daniels LLP

(57) ABSTRACT

A lumbar support of a chair includes a crossbar member and a first flex member. The crossbar member has a first end and a second end. The first flex member includes a first front portion coupled to the first end, a first back portion coupled to the chair, and a first web portion interconnecting the first front portion and the first back portion. The crossbar member supports a back of a user and the first flex member flexes upon engagement of the crossbar member by the back of the user.

8 Claims, 25 Drawing Sheets

(56) References Cited

U.S. PATENT DOCUMENTS 3,453,024 A 7/1969 Williams
3,565,482 A 2/1971 Blodee
4,014,507 A 3/1977 Swenson
4,155,592 A 5/1979 Tsuda et al.
4,168,050 A 9/1979 Nerem et al.
4,429,917 A 2/1984 Diffrient
4,502,729 A 3/1985 Locher
4,623,193 A 11/1986 Lieker
4,653,806 A 3/1987 Willi
4,761,033 A 8/1988 Lanuzzi et al.
4,773,706 A 9/1988 Hinrichs
4,865,384 A 9/1989 Desanta
4,909,472 A 3/1990 Piretti
4,962,962 A 10/1990 Machate et al.
4,988,145 A 1/1991 Engel
5,029,942 A 7/1991 Rink
5,110,182 A 5/1992 Beauvais
5,150,948 A 9/1992 Volkle
5,308,144 A 5/1994 Korn
5,366,274 A 11/1994 Roericht et al.
5,486,035 A 1/1996 Koepke et al.
5,507,559 A 4/1996 Lance
5,599,069 A 2/1997 Lorbiecki
5,601,337 A 2/1997 Choda et al.
5,649,740 A 7/1997 Hodgdon
5,660,439 A 8/1997 Unwalla
5,716,098 A 2/1998 Lance
5,755,488 A 5/1998 Beda et al.
5,772,282 A 6/1998 Stumpf et al.
5,775,774 A 7/1998 Okano
5,797,652 A 8/1998 Darbyshire
5,810,440 A 9/1998 Unwalla
5,826,940 A 10/1998 Hodgdon
5,934,758 A 8/1999 Ritch et al.
RE36,335 E 10/1999 Perry
5,979,984 A 11/1999 Dekraker et al.
6,035,901 A 3/2000 Stumpf et al.
6,176,548 B1 1/2001 Thole et al.
6,254,186 B1 7/2001 Falzon
6,286,900 B1 9/2001 Roark
6,296,309 B1 10/2001 Kurtz
6,318,800 B1 11/2001 DeKraker
6,367,876 B2 4/2002 Caruso et al.
6,367,877 B1 4/2002 Knoblock et al.
6,394,545 B2 5/2002 Knoblock et al.
6,394,546 B1 5/2002 Knoblock et al.
6,394,548 B1 5/2002 Battey et al.
6,394,549 B1 5/2002 DeKraker et al.
6,474,737 B1 11/2002 Canteleux et al.
6,511,128 B2 1/2003 Piretti
6,513,874 B1 2/2003 Sander et al.
6,523,898 B1 2/2003 Ball et al.
6,565,153 B2 5/2003 Hensel et al.
6,568,760 B2 5/2003 Davis et al.
6,572,190 B2 6/2003 Koepke et al.
D476,821 S 7/2003 Koepke et al.
6,588,842 B2 7/2003 Stumpf et al.
6,616,231 B2 8/2003 Koepke et al.
6,626,497 B2 9/2003 Nagamitsu et al.
6,644,741 B2 11/2003 Nelson et al.
6,669,292 B2 12/2003 Koepke et al.
6,688,692 B2 2/2004 Phillips et al.
6,709,057 B2 3/2004 Sander et al.
6,709,058 B1 3/2004 Diffrient
6,709,060 B1 3/2004 Su
6,722,741 B2 4/2004 Stumpf et al.
6,729,691 B2 5/2004 Koepke et al.
6,739,664 B2 5/2004 Kinoshita et al.
6,749,261 B2 6/2004 Knoblock et al.
6,761,406 B2 7/2004 Kinoshita et al.
D493,627 S 8/2004 Ma
6,802,566 B2 10/2004 Prince et al.
6,817,667 B2 11/2004 Pennington et al.
6,840,582 B2 1/2005 Burwell et al.
6,843,530 B1 1/2005 Wu
6,863,346 B2 3/2005 Zund
6,874,852 B2 4/2005 Footitt
6,896,329 B2 5/2005 Sander et al.
6,905,171 B2 6/2005 Dammermann et al.
6,908,159 B2 6/2005 Prince et al.
6,913,316 B2 7/2005 Kinoshita et al.
6,935,689 B2 8/2005 Horiki et al.
6,945,602 B2 9/2005 Fookes et al.
6,957,861 B1 * 10/2005 Chou ..... A47C 3/025 297/284.7
6,959,965 B2 11/2005 Diffrient
6,966,604 B2 11/2005 Stumpf et al.
6,981,743 B2 1/2006 Edwards et al.
6,986,549 B2 1/2006 Kniese
6,991,291 B2 1/2006 Dammermann et al.
6,994,400 B2 2/2006 Koepke et al.
7,014,269 B2 3/2006 Coffield et al.
7,040,709 B2 5/2006 Dammermann et al.
7,063,384 B2 6/2006 Liu
7,066,537 B2 6/2006 Coffield et al.
7,066,538 B2 6/2006 Machael et al.
7,104,604 B1 9/2006 Kang
7,114,777 B2 10/2006 Knoblock et al.
7,131,700 B2 11/2006 Dammermann et al.
7,134,722 B2 11/2006 Ueda et al.
D541,063 S 4/2007 Su
7,213,880 B2 5/2007 Schmitz et al.
7,249,802 B2 5/2007 Schmitz et al.
7,234,772 B2 6/2007 Wells
7,273,253 B2 9/2007 Deimen et al.
7,281,764 B2 10/2007 Thole
D558,995 S 1/2008 Igarashi
D559,571 S 1/2008 Meda
D559,572 S 1/2008 Igarashi
7,347,495 B2 3/2008 Beyer et al.
7,360,835 B2 4/2008 Tubergen et al.
D572,948 S 7/2008 Wakasugi et al.
7,419,222 B2 9/2008 Schmitz et al.
7,422,287 B2 9/2008 Heidmann et al.
7,425,037 B2 9/2008 Schmitz et al.
7,441,839 B2 10/2008 Pennington et al.
D582,170 S * 12/2008 Chi ..... D6/366
7,484,802 B2 2/2009 Beyer et al.
7,517,024 B2 4/2009 Cvek
D600,462 S 9/2009 Ooki et al.
7,600,814 B2 10/2009 Link
7,665,805 B2 2/2010 Ueda
7,712,833 B2 5/2010 Ueda
7,717,513 B2 5/2010 Ueda
D618,469 S 6/2010 Romero
7,726,740 B2 6/2010 Masunaga
7,798,573 B2 9/2010 Pennington et al.
7,837,265 B2 11/2010 Machael et al.
7,841,666 B2 11/2010 Schmitz et al.
7,878,591 B2 2/2011 Walker et al.
D639,576 S 6/2011 Breen
7,971,936 B2 7/2011 Fukai
D643,641 S 8/2011 Figueroa
D643,642 S 8/2011 Figueroa
7,992,937 B2 8/2011 Plikat et al.
7,997,652 B2 8/2011 Roslund et al.
D646,092 S 10/2011 Romero
8,029,060 B2 10/2011 Parker et al.
8,061,775 B2 11/2011 Diffrient
D649,795 S 12/2011 Izawa
8,075,058 B2 12/2011 Baumann
D652,223 S 1/2012 Fujita
8,210,607 B2 * 7/2012 Takayasu ..... B60N 2/888 297/216.12
8,210,611 B2 7/2012 Aldrich et al.
8,215,710 B2 7/2012 Erker
8,251,448 B2 8/2012 Machael et al.
8,262,162 B2 9/2012 Castro et al.
8,297,701 B2 10/2012 Machael et al.
D671,759 S 12/2012 Hurford
D676,254 S 2/2013 Chen
8,414,073 B2 4/2013 Schmitz et al.
D688,483 S 8/2013 Aratani
8,550,557 B2 10/2013 Bock

(56) References Cited

U.S. PATENT DOCUMENTS

| | | | | |
|---|---|---|---|---|
| D696,886 | S | 1/2014 | Nakamura | |
| D701,068 | S | 3/2014 | Usumoto et al. | |
| D704,944 | S | 5/2014 | Koepke et al. | |
| D707,460 | S | 6/2014 | Giugiaro | |
| D714,070 | S | 9/2014 | Cvek | |
| D715,068 | S | 10/2014 | Chan | |
| D718,544 | S | 12/2014 | Lu | |
| D731,833 | S | 6/2015 | Fifield et al. | |
| 2002/0036422 | A1* | 3/2002 | Prince | A47C 1/023 297/411.35 |
| 2002/0043843 | A1 | 4/2002 | Pennington et al. | |
| 2002/0190552 | A1 | 12/2002 | Koepke et al. | |
| 2002/0190553 | A1 | 12/2002 | Koepke et al. | |
| 2002/0190564 | A1 | 12/2002 | Coffield et al. | |
| 2003/0001425 | A1 | 1/2003 | Koepke et al. | |
| 2003/0075961 | A1 | 4/2003 | Struppler et al. | |
| 2003/0107252 | A1 | 6/2003 | Kinoshita et al. | |
| 2003/0127896 | A1 | 7/2003 | Deimen et al. | |
| 2003/0137173 | A1 | 7/2003 | Kinoshita et al. | |
| 2004/0017102 | A1 | 1/2004 | Igarashi et al. | |
| 2005/0017555 | A1* | 1/2005 | Elliot | B60N 2/6671 297/284.4 |
| 2005/0062323 | A1 | 3/2005 | Dicks | |
| 2005/0093354 | A1 | 5/2005 | Ball et al. | |
| 2005/0121954 | A1 | 6/2005 | Coffield et al. | |
| 2005/0231013 | A1 | 10/2005 | Knoblock et al. | |
| 2005/0269848 | A1 | 12/2005 | Harley | |
| 2006/0001303 | A1 | 1/2006 | Raftery et al. | |
| 2006/0006715 | A1 | 1/2006 | Chadwick et al. | |
| 2006/0033369 | A1 | 2/2006 | Eysing | |
| 2006/0103208 | A1 | 5/2006 | Schmitz et al. | |
| 2006/0181126 | A1 | 8/2006 | Eysing | |
| 2007/0057549 | A1 | 3/2007 | Ball et al. | |
| 2007/0063561 | A1* | 3/2007 | McMillen | A47C 7/465 297/284.8 |
| 2007/0108818 | A1 | 5/2007 | Ueda et al. | |
| 2007/0108819 | A1 | 5/2007 | Ueda | |
| 2007/0108820 | A1 | 5/2007 | Ueda et al. | |
| 2007/0108821 | A1 | 5/2007 | Ueda | |
| 2007/0216208 | A1* | 9/2007 | Maier | A47C 7/46 297/284.4 |
| 2008/0272636 | A1 | 11/2008 | Machael et al. | |
| 2010/0013283 | A1* | 1/2010 | Koike | B60N 2/66 297/284.4 |
| 2010/0078975 | A1* | 4/2010 | Kang | A47C 7/462 297/230.13 |
| 2010/0295351 | A1 | 11/2010 | Bock | |
| 2011/0074197 | A1 | 3/2011 | Okamoto | |
| 2011/0193384 | A1 | 8/2011 | Ni | |
| 2011/0198909 | A1 | 8/2011 | Fifield | |
| 2011/0233979 | A1 | 9/2011 | An | |
| 2011/0285190 | A1 | 11/2011 | Wu | |
| 2011/0285191 | A1 | 11/2011 | van Hekken | |
| 2012/0007400 | A1 | 1/2012 | Behar et al. | |
| 2012/0013161 | A1* | 1/2012 | Adams | A47C 7/462 297/284.2 |
| 2012/0025574 | A1 | 2/2012 | Wilkinson et al. | |
| 2012/0242130 | A1* | 9/2012 | Hung | A47C 7/46 297/344.18 |
| 2012/0306247 | A1* | 12/2012 | Bisman | A47C 7/462 297/284.7 |
| 2013/0169014 | A1 | 7/2013 | Machael et al. | |
| 2014/0125102 | A1* | 5/2014 | McMillen | B60N 2/66 297/284.4 |
| 2014/0265493 | A1 | 9/2014 | Machael et al. | |
| 2015/0296989 | A1* | 10/2015 | Machael | A47C 7/44 297/284.7 |

FOREIGN PATENT DOCUMENTS

| | | | | |
|---|---|---|---|---|
| DE | 3640336 | A1 | 8/1987 | |
| DE | 29507658 | U1 | 2/1996 | |
| DE | 4437394 | A1 | 4/1996 | |
| DE | 29711329 | U1 | 10/1997 | |
| DE | 10318759 | B3 | 7/2004 | |
| DE | 202008016260 | U1 | 4/2009 | |
| EP | 0574375 | A1 | 12/1993 | |
| EP | 0688522 | A1 | 12/1995 | |
| EP | 0970639 | A1 | 1/2000 | |
| EP | 1232703 | B1 | 8/2002 | |
| EP | 1768516 | B1 | 4/2007 | |
| EP | 2110051 | A1 | 10/2009 | |
| EP | 2622991 | A1 | 8/2013 | |
| EP | 2622991 | A1 * | 8/2013 | A47C 7/46 |
| JP | 2004049658 | A | 2/2004 | |
| JP | 2004049691 | A | 2/2004 | |
| KR | 20030059582 | A | 7/2003 | |
| OM | ID201400020 | S | 6/2015 | |
| WO | WO199220262 | A1 | 11/1992 | |
| WO | WO2002102197 | A2 | 12/2002 | |
| WO | WO2003068025 | A2 | 8/2003 | |
| WO | WO2004008915 | A1 | 1/2004 | |
| WO | 2007112236 | A1 | 10/2007 | |
| WO | WO2013020088 | A2 | 2/2013 | |
| WO | 2014144143 | A1 | 9/2014 | |
| WO | 2015160693 | A1 | 10/2015 | |

OTHER PUBLICATIONS

"Contessa: Ergonomic Concept", Okamura Today, copyright 2000-2004 Okamura Corporation, downloaded from http://www.okamura.co/jp/english/product/office/contessa/concept/index.html, 2 pages.

International Preliminary Report on Patentability issued in PCT/US2014/028431, dated Sep. 24, 2015, 6 pages.

International Search Report and Written Opinion for PCT/US2008/056890 of HNI Technologies Inc., dated Jul. 17, 2008.

International Search Report and Written Opinion issued in PCT/US2007/064413, dated Aug. 16, 2007, 11 pages.

International Search Report and Written Opinion issued in PCT/US2014/028431, dated Jul. 7, 2014, 9 pages.

International Search Report and Written Opinion issued in PCT/US2015/025546, dated Aug. 14, 2015, 10 pages.

International Preliminary Report on Patentability issued in International Application No. PCT/US2015/025546 dated Oct. 27, 2016, 8 pages.

* cited by examiner

FLEX LUMBAR SUPPORT

CROSS-REFERENCE TO RELATED APPLICATION

This application claims priority to Provisional Application No. 61/981,060, filed Apr. 17, 2014, which is incorporated herein by reference in its entirety.

BACKGROUND

Chair manufacturers continually strive to improve the comfort, benefits, aesthetics, and manufacturability of the chairs they produce. Often, chairs have features, such as a reclining back, to increase comfort. Sometimes, chairs have features, such as adjustable seats, backs, back supports, armrests, and heights, to reduce or prevent injuries, including repetitive stress injury and back pain associated with sitting for long periods. Chairs are designed and built to fill an individual's needs and provide support where the individual needs it. In some chairs, the seat and back are fixed or the seat is fixed and the back tilts for comfort. In other chairs, the seat and back move together to support the user. Also, some chairs include a lumbar support mechanism for supporting the lower back or lumbar area of the user.

SUMMARY

In some embodiments, a lumbar support of a chair includes a crossbar member and a first flex member. The crossbar member has a first end and a second end. The first flex member includes a first front portion coupled to the first end, a first back portion coupled to the chair, and a first web portion interconnecting the first front portion and the first back portion, wherein the crossbar member supports a back of a user and the first flex member flexes upon engagement of the crossbar member by the back of the user.

In some embodiments, the lumbar support includes a second flex member that includes a second front portion coupled to the second end, a second back portion coupled to the chair, and a second web portion interconnecting the second front portion and the second back portion, wherein the first flex member and the second flex member flex upon engagement of the crossbar member by the back of the user.

In some embodiments, a chair includes a base, a seat, a back, and a lumbar support. The base is to support the chair on a surface and the seat is supported by the base. The back is supported by the base and includes a flexible back support. The lumbar support includes a crossbar member, a first flex member, and a second flex member. The crossbar member has a first end and a second end. The first flex member includes a first front portion coupled to the first end, a first back portion coupled to the back, and a first web portion interconnecting the first front portion and the first back portion. The second flex member includes a second front portion coupled to the second end, a second back portion coupled to the back, and a second web portion interconnecting the second front portion and the second back portion, wherein the first flex member and the second flex member flex and provide local resistance to flexing of the flexible back support upon engagement of the crossbar member by a user.

In some embodiments, a chair back includes a back, an upright frame, a first flex wing, and a first lumbar member. The back support has a first side portion and a second side portion. The upright frame has a first frame side and a second frame side, and the first flex wing is located between the first frame side and the first side portion. The first lumbar member includes a first front portion engaged with the back support, a first back portion coupled to one of the first frame side and the first flex wing, and a first web portion interconnecting the first front portion and the first back portion, such that the first lumbar member flexes and provides local resistance to compression of the first flex wing.

In some embodiments, the chair back includes a second flex wing and a second lumbar member. The second flex wing is located between the second frame side and the second side portion. The second lumbar member includes a second front portion engaged with the back support, a second back portion coupled to one of the second frame side and the second flex wing, and a second web portion interconnecting the second front portion and the second back portion, such that the second lumbar member flexes and provides local resistance to compression of the second flex wing.

In some embodiments a method of making a chair includes forming a lumbar support member having a first flex member and a second flex member, engaging a first back portion of the first flex member with a first lumbar track of a back of the chair, and engaging a second back portion of the second flex member with a second lumbar track of the back of the chair.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
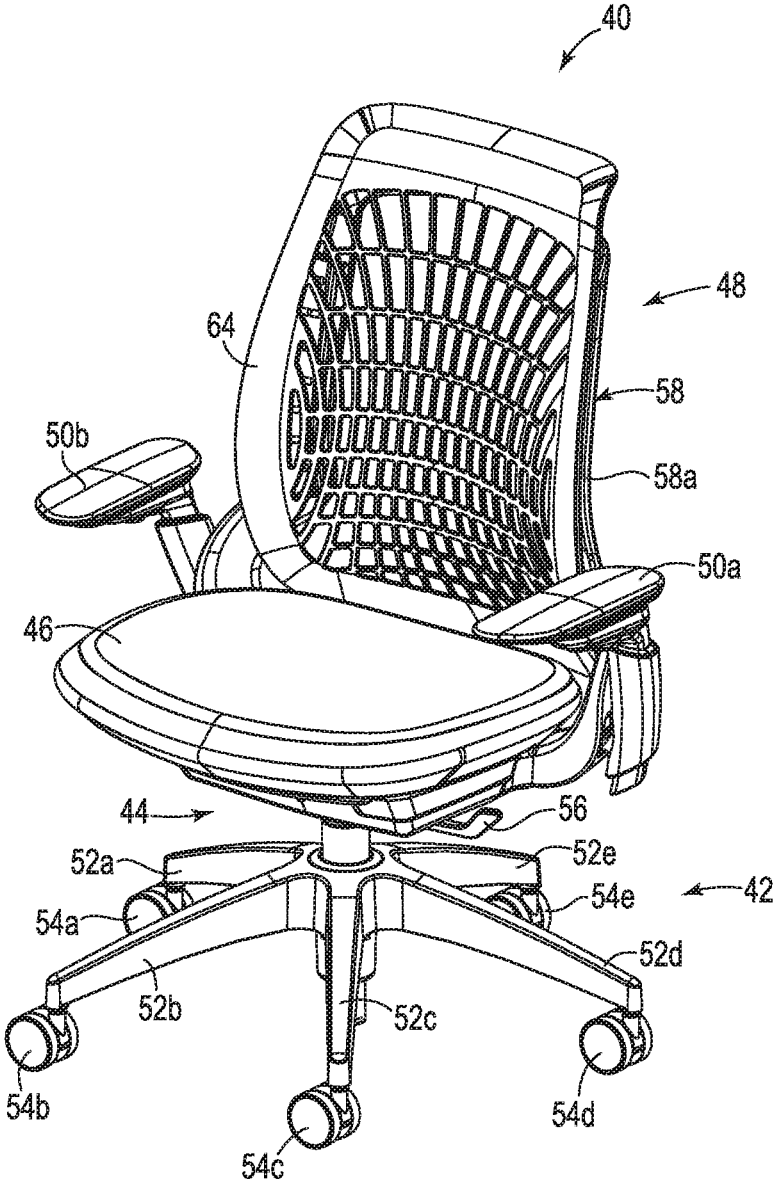
FIG. 1 is a diagram illustrating a perspective view of a chair, according to some embodiments.
Figure 2:
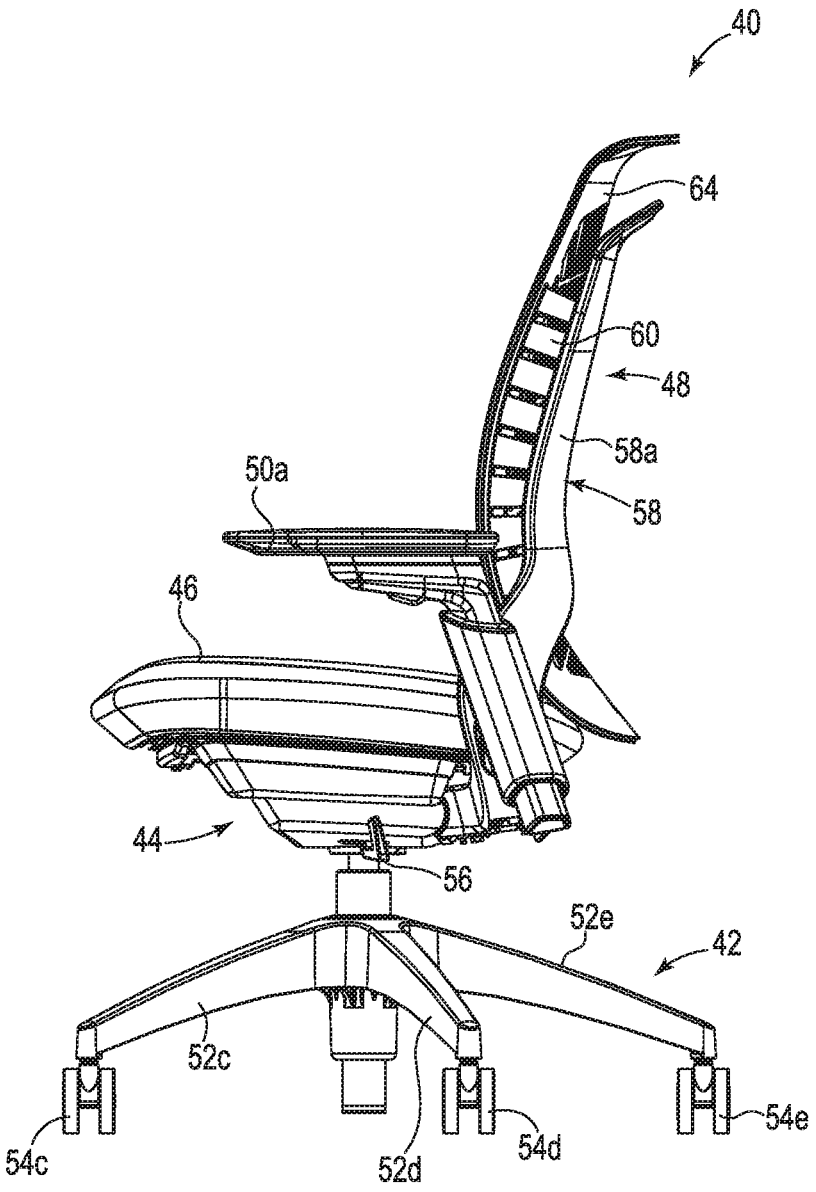
FIG. 2 is a diagram illustrating a side view of the chair of FIG. 1, according to some embodiments.
Figure 3:
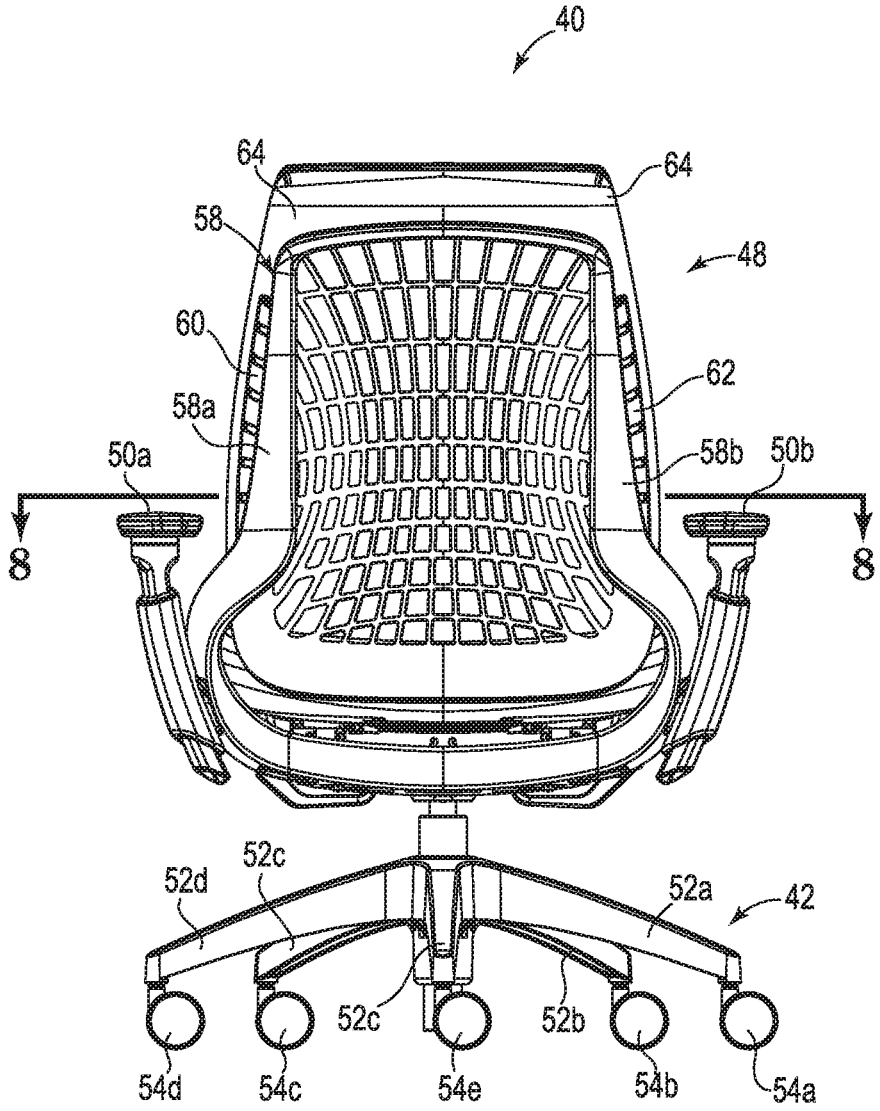
FIG. 3 is a diagram illustrating a back view of the chair of FIG. 1, according to some embodiments.

FIGS. 1-3 are diagrams illustrating a chair 40, according to some embodiments described in the disclosure. FIG. 1 is a diagram illustrating a perspective view of the chair 40, according to some embodiments. FIG. 2 is a diagram illustrating a side view of the chair 40, according to some embodiments. FIG. 3 is a diagram illustrating a back view of the chair 40, according to some embodiments. The other side of the chair 40 is, optionally, a mirror image of the side shown in FIG. 2, but otherwise substantially similar, such that the other side can be described with reference to the side shown in FIG. 2.

The chair 40 includes a base 42, a hub 44, a seat 46, a back 48, and armrests 50*a* and 50*b*. The base 42 supports the chair 40, including the hub 44, the seat 46, and the back 48, on a surface, such as the floor of an office building. The hub 44 is connected to the base 42, and the seat 46 and the back 48 are connected to and supported by the hub 44. In some embodiments, the armrests 50*a* and 50*b* are attached to the back 48. In some embodiments, the armrests 50*a* and 50*b* are attached to the hub 44. In some embodiments, the chair 40 does not include the armrests 50*a* and 50*b*.

The base 42 includes leg supports 52*a*-52*e* that support the chair 40 on the surface. Each of the leg supports 52*a*-52*e* includes a corresponding wheel 54*a*-54*e* for rolling the chair 40 on the surface. In some embodiments, the base 42 includes fewer than five leg supports 52*a*-52*e*. In some embodiments, the base 42 includes more than five leg supports 52*a*-52*e*. In some embodiments, each of the leg supports 52*a*-52*e* includes a corresponding foot, such that the chair 40 does not roll.

In some embodiments, the hub 44 is rotatably connected to the base 42, such that the seat 46 and the back 48 swivel on the base 42 via the rotating hub 44. In some embodiments, the hub 44 includes a lever arm 56 for adjusting the seat height or other adjustable aspects of the chair 40. In some embodiments, the hub 44 includes a weight activated control mechanism for raising and lowering the seat 46 in response to the user leaning or applying weight, or force, to the back 48.

The seat 46 supports the body of the user and the armrests 50*a* and 50*b* support the arms of the user. In some embodiments, each of the armrests 50*a* and 50*b* swivels to move with an arm of the user. In some embodiments, the height of each of the armrests 50*a* and 50*b* is adjustable to accommodate users of different sizes.

The back 48 supports the back of the user and flexes or bends to accommodate movements of the user. The back 48 includes an upright frame 58, first and second flexible (flex) wings 60 and 62, and a back support 64.

The upright frame 58 is supported by the base 42. In some embodiments, the upright frame 58 is secured to the base 42. In some embodiments, the upright frame 58 is secured to the hub 44.

The upright frame 58 includes a first frame side 58*a* and a second frame side 58*b*. In some embodiments, the upright frame 58 is U-shaped, with one arm of the U-shaped frame at the first frame side 58*a* and the other, opposite arm at the second frame side 58*b*. In some embodiments, the upright frame 58 is Y-shaped, with one arm of the Y-shaped frame at the first frame side 58*a* and the other, opposite arm at the second frame side 58*b*. In some embodiments, the upright frame 58 is H-shaped, with one arm of the H-shaped frame at the first frame side 58*a* and the other, opposite arm at the second frame side 58*b* and an interconnecting member (not shown) extending between the first and second frame sides 58*a*, 58*b*. In some embodiments, the upright frame 58 is a closed loop frame, such as a rectangular, circular, or oval shaped frame. In some embodiments, the upright frame 58 is a shell, such as a solid shell or a rigid shell, which extends from the first frame side 58*a* to the second frame side 58*b*.

As shown, the back support 64 is attached to the upright frame 58 at the first frame side 58*a* and the second frame side 58*b* via the first and second flex wings 60 and 62. The first flex wing 60 is situated between the first frame side 58*a* and the back support 64 and the second flex wing 62 is situated between the second frame side 58*b* and the back support 64.

Figure 4:
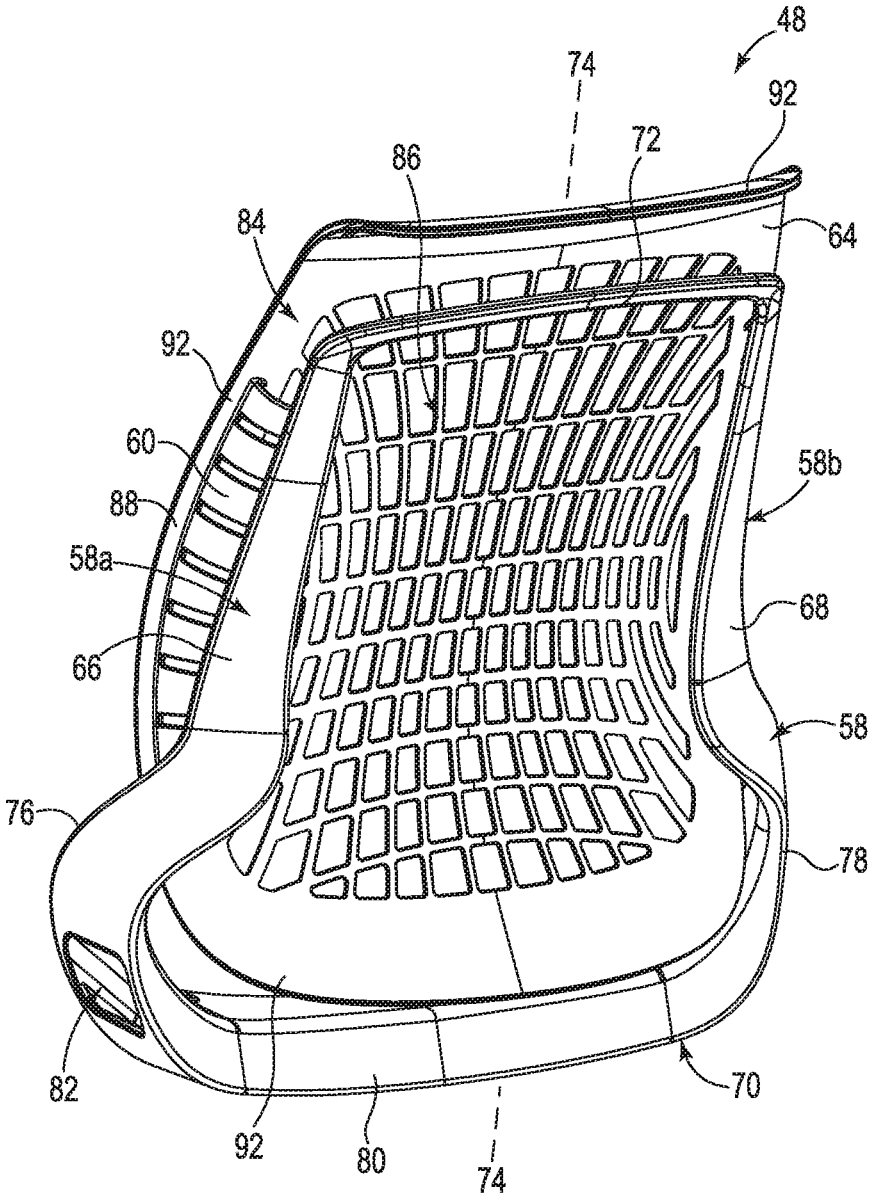
FIG. 4 is a diagram illustrating a rear perspective view of a back, according to some embodiments.
Figure 5:
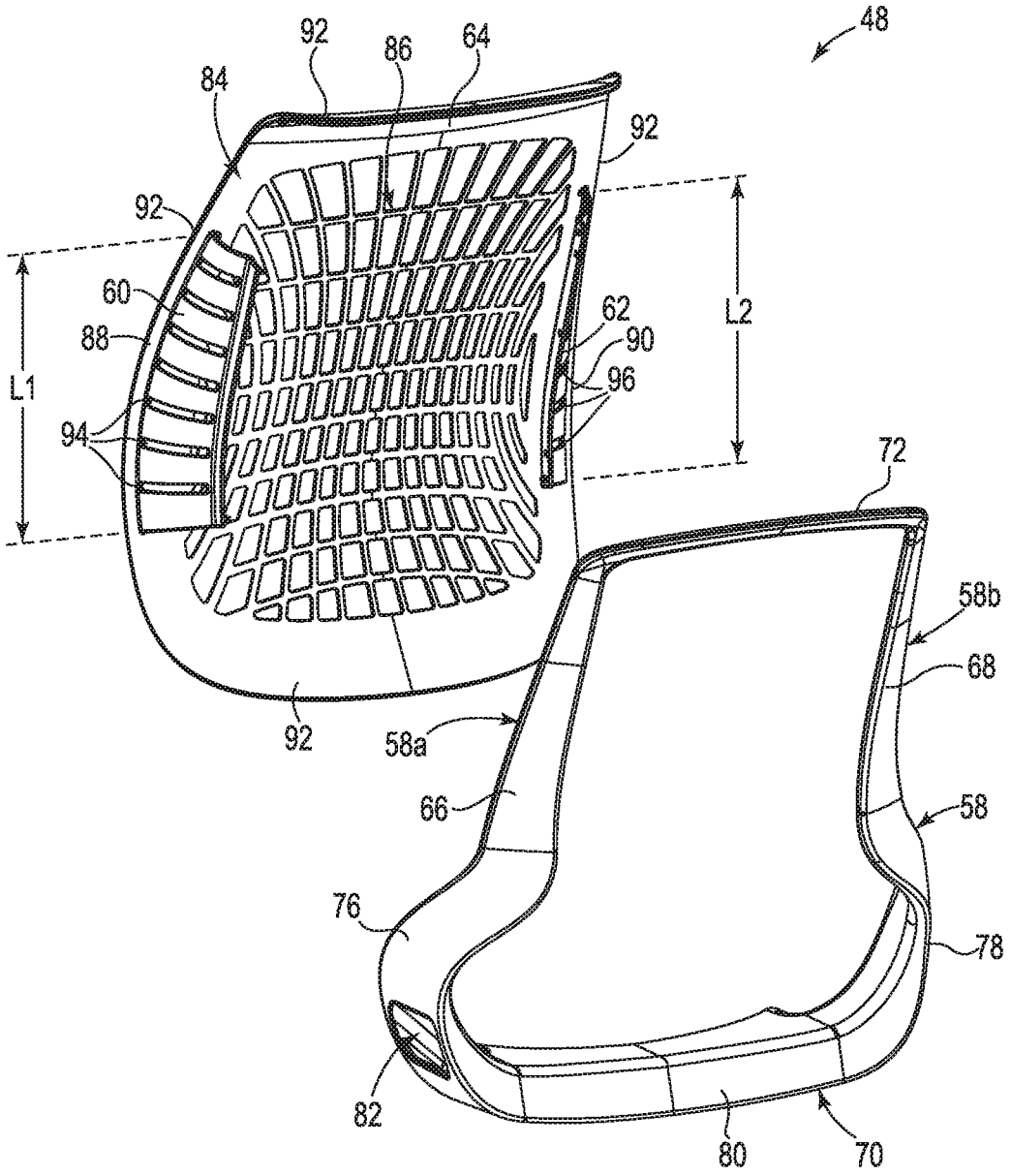
FIG. 5 is a diagram illustrating a rear exploded view of the back of FIG. 4, according to some embodiments.
Figure 6:
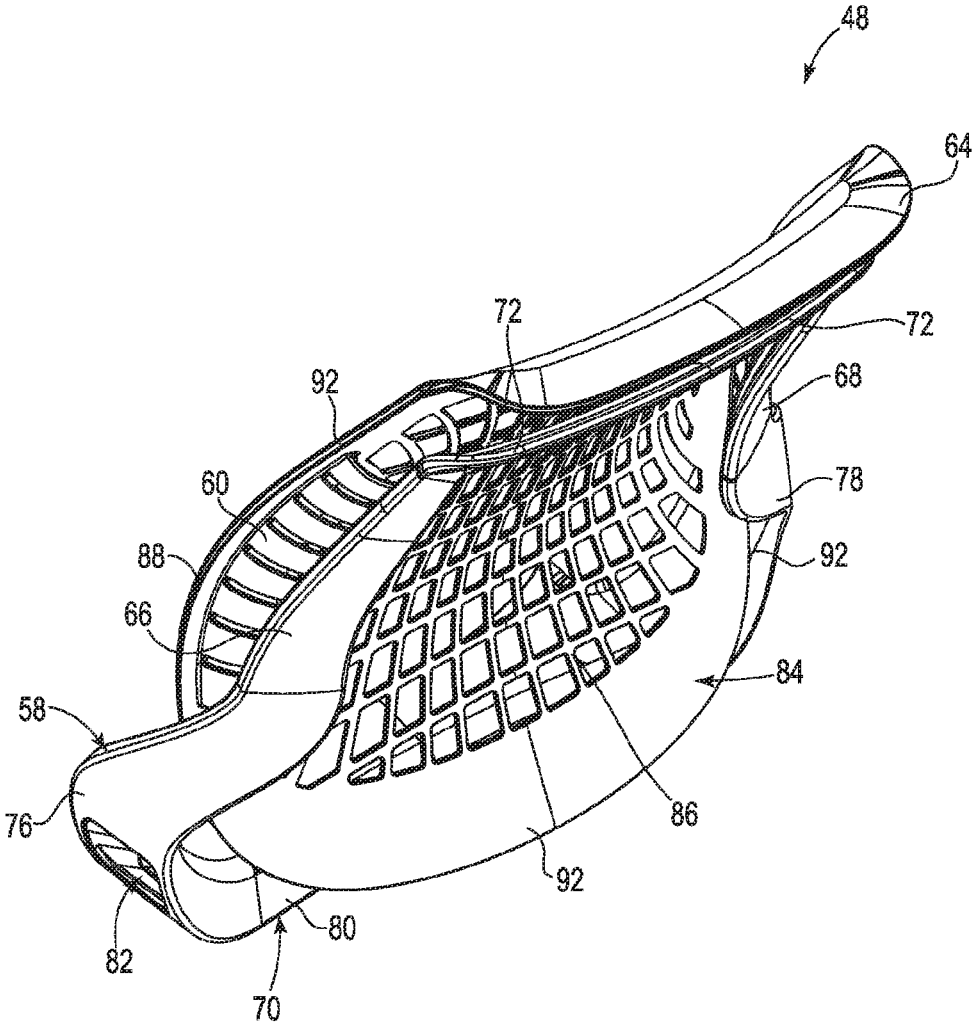
FIG. 6 is a diagram illustrating a rear top perspective view of the back of FIG. 4, according to some embodiments.
Figure 7:
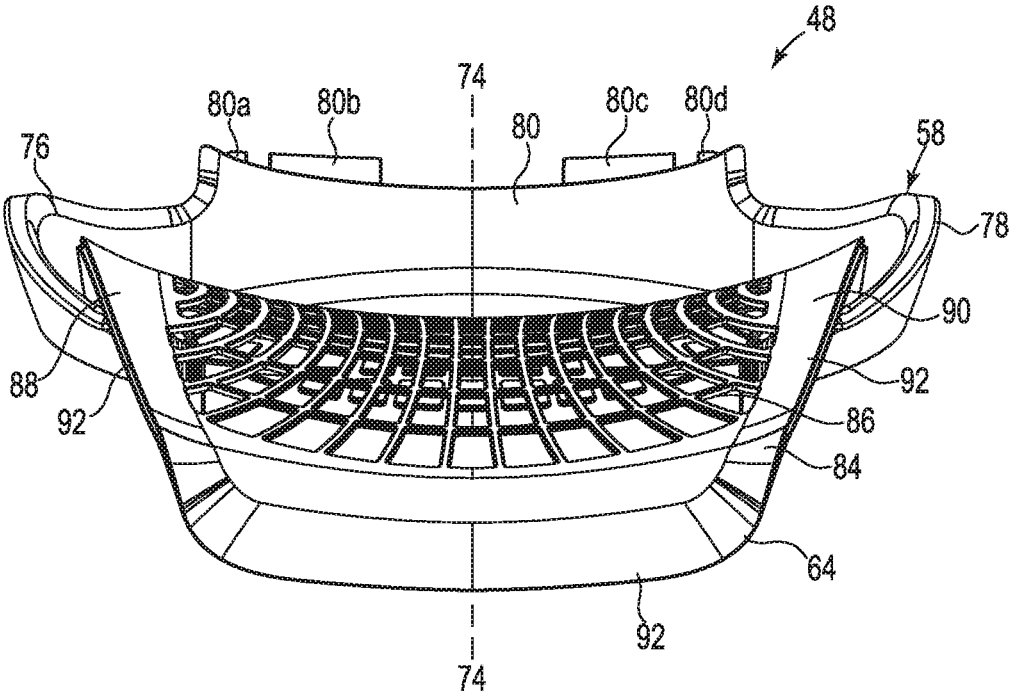
FIG. 7 is a diagram illustrating a top view of the back of FIG. 4, according to some embodiments.

FIGS. 4-7 are diagrams illustrating the back 48 of the chair 40, according to some embodiments. FIG. 4 is a diagram illustrating a rear perspective view of the back 48, according to some embodiments. FIG. 5 is a diagram illustrating a rear exploded view of the back 48, according to some embodiments. FIG. 6 is a diagram illustrating a rear top perspective view of the back 48, according to some embodiments. FIG. 7 is a diagram illustrating a top view of the back 48, according to some embodiments. As shown, the first and second flex wings 60 and 62 secure the back support 64 to the upright frame 58 and flex in response to application of a back force by the a user.

In some embodiments, the upright frame 58 that is illustrated in FIGS. 4-7 is substantially rigid and includes a first back upright 66, a second back upright 68, a bottom transverse member 70, and a top transverse member 72. A shown, the upright frame 58 is a closed loop frame that is substantially rectangular, where the first back upright 66 is substantially rigid and situated at the first frame side 58*a* and the second back upright 68 is substantially rigid and situated at the second frame side 58*b*. In some embodiments, the upright frame 58 is formed from cast aluminum. In some embodiments, the upright frame 58 is formed from molded plastic.

In some embodiments, the upright frame 58 includes the first back upright 66, the second back upright 68, and the bottom transverse member 70, but not the top transverse member 72, to form a U-shaped upright frame 58. In some embodiments, the upright frame 58 includes the first back upright 66 and the second back upright 68 to form an H-shaped upright frame 58. In some embodiments, the upright frame 58 includes the first back upright 66 and the second back upright 68 secured directly to the hub 44 or directly to the base 42. In some embodiments, the upright frame 58 includes the first back upright 66 and the second back upright 68 positioned at an angle from the center line 74 of the back 48 to provide a Y-shaped upright frame 58. In some embodiments, each of the first back upright 66 and the second back upright 68 includes a lumbar support adjustment track for receiving an adjustable lumbar support.

In the upright frame 58 that is illustrated in FIGS. 4-7, the bottom transverse member 70 is substantially rigid and secured to the hub 44, which secures the upright frame 58 to the hub 44. The bottom transverse member 70 includes first and second corner portions 76 and 78 and a bottom portion 80 that includes back frame inserts 80*a*-80*d* (shown in FIG. 7). The bottom transverse member 70 is secured to the hub 44 by inserting and securing the back frame inserts 80*a*-80*d* in the hub 44. In some embodiments, each of the corner portions 76 and 78 includes an arm receiving opening, such as arm receiving opening 82, for engaging and securing the armrests 50*a* and 50*b* to the upright frame 58.

The first back upright 66 is attached to the second back upright 68 by the bottom transverse member 70, such that the first back upright 66, the second back upright 68, and the bottom transverse member 70 form a U-shaped support. The first back upright 66 is secured to the first corner portion 76 and the second back upright 68 is secured to the second corner portion 78. In some embodiments, the first back upright 66, the second back upright 68, and the bottom transverse member 70 are integrally formed, i.e., as a single, monolithic piece. In some embodiments, the first back upright 66, the second back upright 68, and the bottom transverse member 70 are integrally formed in the same manufacturing process step. In some embodiments, the first back upright 66, the second back upright 68, and the bottom transverse member 70 are molded as a single, monolithic piece. In some embodiments, the first back upright 66, the second back upright 68, and the bottom transverse member 70 are separate pieces that are secured together, such as with one or more of adhesives, welding, fasteners, and mechanical engagement with each other.

The top transverse member 72 is substantially rigid and secured to the first back upright 66 and the second back upright 68. The first back upright 66, the second back upright 68, the bottom transverse member 70, and the top transverse member 72 form the closed loop upright frame 58. In some embodiments, the first back upright 66, the second back upright 68, the bottom transverse member 70, and the top transverse member 72 are integrally formed, i.e., as a single, monolithic piece. In some embodiments, the first back upright 66, the second back upright 68, the bottom transverse member 70, and the top transverse member 72 are integrally formed in the same manufacturing process step. In some embodiments, the first back upright 66, the second back upright 68, the bottom transverse member 70, and the top transverse member 72 are molded as a single, monolithic piece. In some embodiments, two or more of the first back upright 66, the second back upright 68, the bottom transverse member 70, and the top transverse member 72 are separate pieces that are secured together, such as with one or more of adhesives, welding, fasteners, and mechanical engagement with each other.

The back support 64 is substantially flexible and has an outer region 84 and a central region 86. The outer region 84 includes a first side portion 88 and a second side portion 90. In some embodiments, the back support 64 is integrally formed, i.e., as a single, monolithic piece. In some embodiments, the back support 64 includes separate pieces that are secured together, such as with one or more of adhesives, welding, fasteners, and mechanical engagement with each other. In some embodiments, the back support 64 is formed of a flexible material, such as a thermoplastic. In some embodiments, the back support 64 is formed of a flexible material, including a thermoplastic elastomer. In some embodiments, the back support 64 is formed of a molded plastic that flexes under the weight of the user. In some embodiments, the back support 64 is formed of a molded thermoplastic.

The outer region 84 defines a perimeter ring 92 and the central region 86 defines a plurality of apertures arranged in a grid pattern that, optionally, increases the flexibility of the back support 64 in the central region 86. The perimeter ring 92 includes the first side portion 88 and the second side portion 90. In some embodiments, the central region 86 includes a mesh material for supporting the user, where the mesh material is attached to the perimeter ring 92. In some embodiments, the back support 64 includes a knit upholstery for supporting the user, where the knit upholstery is attached to the perimeter ring 92. In some embodiments, the back support 64 includes a molded plastic ring carrier at the perimeter ring 92 and a mesh is secured to the molded plastic ring carrier.

The first and second flex wings 60 and 62 secure the back support 64 to the upright frame 58. The first flex wing 60 is attached to or part of the first side portion 88 of the back support 64, and the second flex wing 62 is attached to or part of the second side portion 90 of the back support 64. The first flex wing 60 includes first notches 94 defined along the length L1 of the first flex wing 60 and the second flex wing 62 includes second notches 96 defined along the length L2 of the second flex wing 62. The flexibility of the first and second flex wings 60 and 62 can be adjusted based on the number of first and second notches 94 and 96 per unit length. Also, the flexibility of the first and second flex wings 60 and 62 can be adjusted based on the thickness of the first and second flex wings 60 and 62. In some embodiments, the first and second flex wings 60 and 62 and the back support 64 are integrally formed, i.e., as a single, monolithic piece. In some embodiments the first and second flex wings 60 and 62 and the back support 64 are integrally formed in the same manufacturing process step. In some embodiments, the first and second flex wings 60 and 62 and the back support 64 are molded as a single, monolithic piece. In some embodiments, the first and second flex wings 60 and 62 are separate pieces attached to the back support 64, such as with one or more of adhesives, welding, fasteners, and mechanical engagement with the back support 64.

Figure 8:
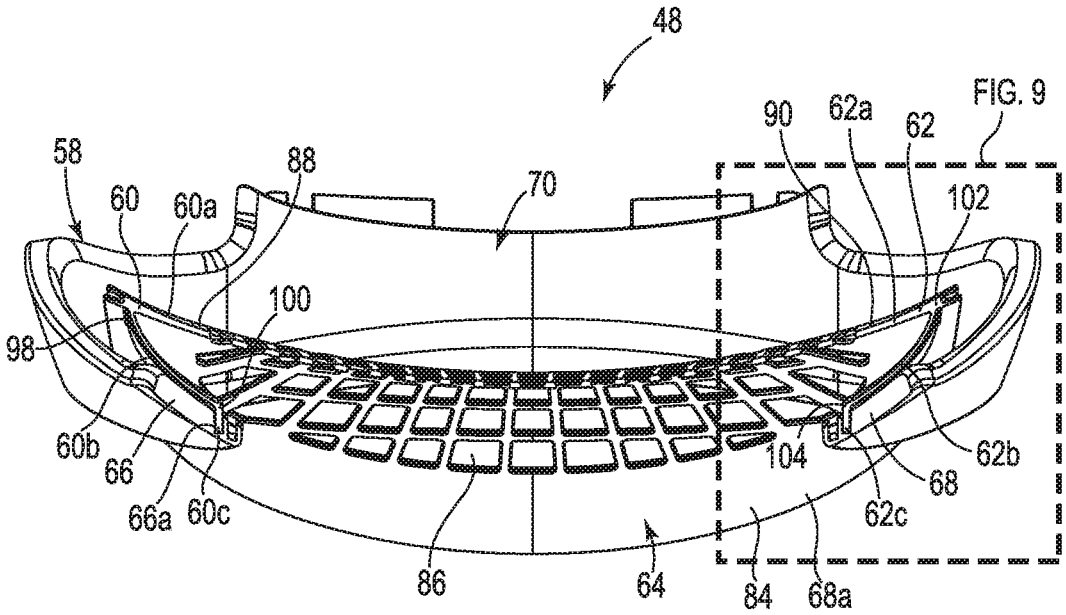
FIG. 8 is a cross-section diagram illustrating the back of FIG. 4 taken along the line 8-8 in FIG. 3, according to some embodiments.
Figure 9:
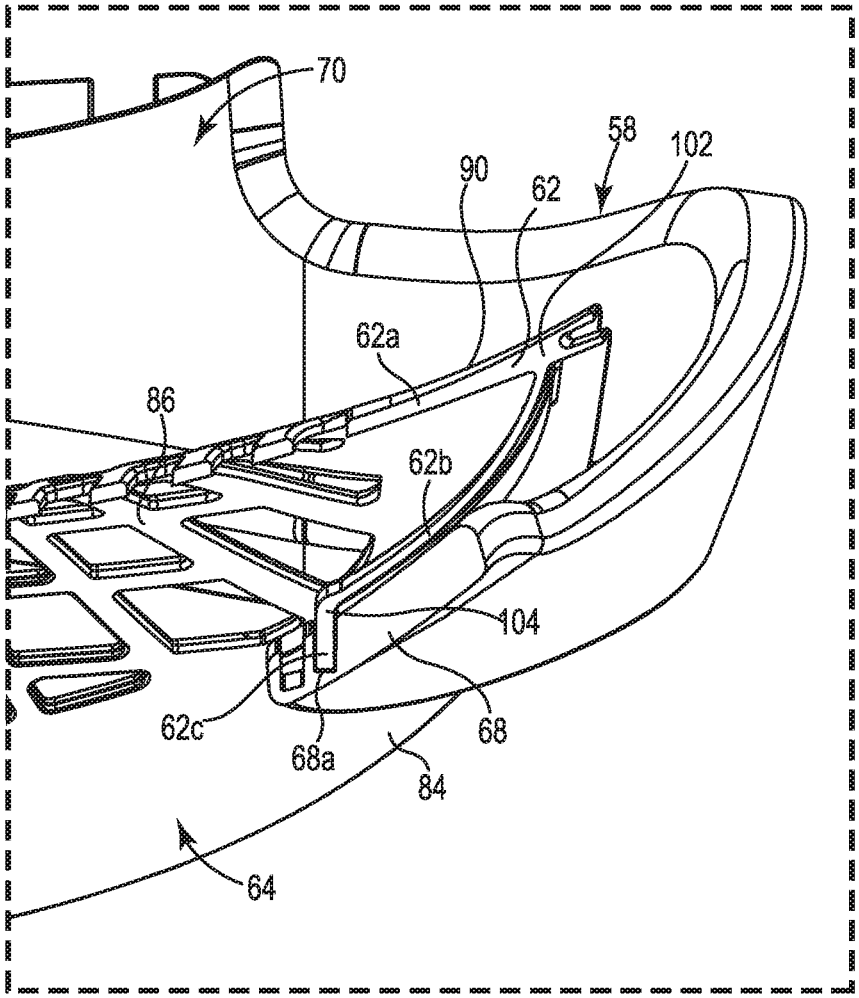
FIG. 9 is an enlarged diagram illustrating one side of the back of FIG. 8, according to some embodiments.

FIG. 8 is a cross-section diagram illustrating the back 48 taken along the line 8-8 in FIG. 3, according to some embodiments, and FIG. 9 is an enlarged diagram illustrating one side of the back 48 as indicated in FIG. 8, according to some embodiments. The back 48 includes the upright frame 58, including the first back upright 66, the second back upright 68, and the bottom transverse member 70; the back support 64, including the outer region 84, the first side portion 88, the second side portion 90, and the central region 86; and the first and second flex wings 60 and 62.

The first and second flex wings 60 and 62 are each Y-shaped or, alternatively, lambda-shaped resilient pieces that flex during user engagement with the back support 64. The first flex wing 60 includes a first front portion 60*a*, a first web portion 60*b*, and a first back portion 60*c*. The second flex wing 62 includes a second front portion 62*a*, a second web portion 62*b*, and a second back portion 62*c*. In some embodiments, the first front portion 60*a*, the first web portion 60*b*, and the first back portion 60*c* are integrally formed, i.e., as a single, monolithic piece. In some embodiments, the second front portion 62*a*, the second web portion 62*b*, and the second back portion 62*c* are integrally formed, i.e., as a single, monolithic piece. In some embodiments, the first front portion 60*a*, the first web portion 60*b*, and the first back portion 60*c* are integrally formed in the same manufacturing process step. In some embodiments, the second front portion 62*a*, the second web portion 62*b*, and the second back portion 62*c* are integrally formed in the same manufacturing process step. In some embodiments, the first front portion 60*a*, the first web portion 60*b*, and the first back portion 60*c* are formed of a resilient flexible material, such as a molded plastic. In some embodiments, the second front portion 62*a*, the second web portion 62*b*, and the second back portion 62*c* are formed of a resilient flexible material, such as a molded plastic. In some embodiments, two or more of the first front portion 60*a*, the first web portion 60*b*, and the first back portion 60*c* are separate pieces attached together, such as with one or more of adhesives, welding, fasteners, and mechanical engagement. In some embodiments, two or more of the second front portion 62*a*, the second web portion 62*b*, and the second back portion 62*c* are separate pieces attached together, such as with one or more of adhesives, welding, fasteners, and mechanical engagement.

The first and second flex wings 60 and 62 secure the back support 64 to the upright frame 58. The first front portion 60*a* of the first flex wing 60 is attached to or part of the first side portion 88 of the back support 64, and the second front portion 62*a* of the second flex wing 62 is attached to or part of the second side portion 90 of the back support 64. Also, the first back portion 60*c* is inserted and secured in a first receiving channel 66*a* of the first back upright 66 to secure the first flex wing 60 to the first back upright 66, and the second back portion 62*c* is inserted and secured in a second receiving channel 68*a* of the second back upright 68 to secure the second flex wing 62 to the second back upright 68.

The first and second flex wings 60 and 62 flex in response to the weight of a user. The first flex wing 60 includes a first flex region 98 defined by the first front portion 60*a* and the first web portion 60*b* and a second flex region 100 defined by the first web portion 60*b* and the first back portion 60*c*. The second flex wing 62 includes a third flex region 102 defined by the second front portion 62*a* and the second web portion 62*b*, and a fourth flex region 104 defined by the second web portion 62*b* and the second back portion 62*c*. In some embodiments, the first and second web portions 60*b* and 62*b* extend away from the first and second front portions 60*a* and 62*a*, respectively, at an acute angle. In some embodiments, the first and second web portions 60*b* and 62*b* extend away from the first and second front portions 60*a* and 62*a*, respectively, at an angle in the range of 20-80 degrees. In some embodiments, the first and second web portions 60*b* and 62*b* extend away from the first and second back portions 60*c* and 62*c*, respectively, at an obtuse angle. In other embodiments, the first and second web portions 60*b* and 62*b* extend away from the first and second back portions 60*c* and 62*c*, respectively, at an acute angle.

Figure 10A:
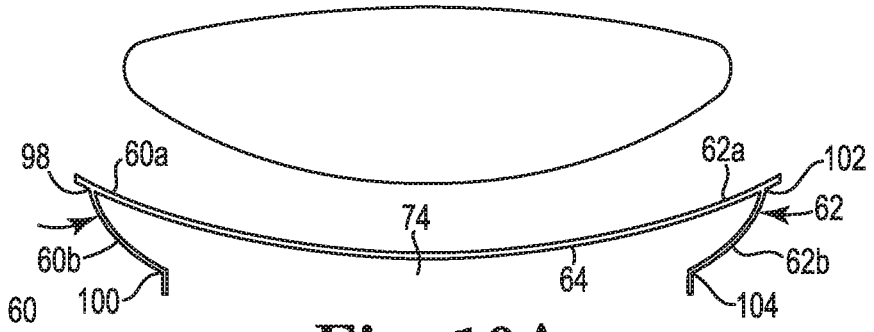
FIGS. 10A-10D are diagrams illustrating the flexing action of the first and second flex wings, according to some embodiments.

FIGS. 10A-10D are diagrams illustrating the flexing action of the first and second flex wings 60 and 62, according to some embodiments. The first and second flex wings 60 and 62 flex in response to a user leaning back in the chair 40 and applying weight to the back support 64. FIG. 10A is a diagram illustrating the first and second flex wings 60 and 62 at rest, prior to user weight being applied to the back support 64.

Figure 10B:
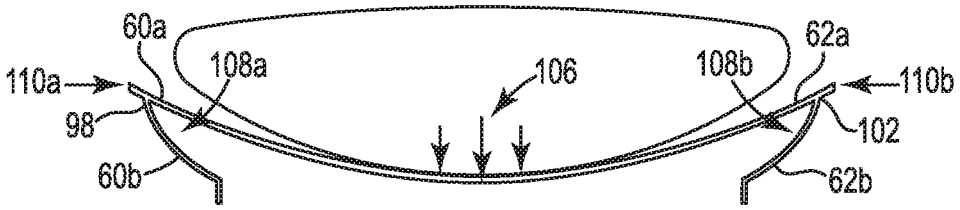

As shown in FIG. 10B, as the back support 64 bows under user weight, indicated by arrows at 106, the front portions 60*a* and 62*a* flex inwardly, indicated by arrows at 108*a* and 108*b*, toward the web portions 60*b* and 62*b* and about the first flex region 98 and the third flex region 102. Also, edges of the first and second flex wings 60 and 62 move toward the center line 74 of the back 48, indicated by arrows 110*a* and 110*b*. In some embodiments, a concentrated center load flexes the first and second flex wings 60 and 62 such that the back support 64 embraces the user.

Figure 10C:
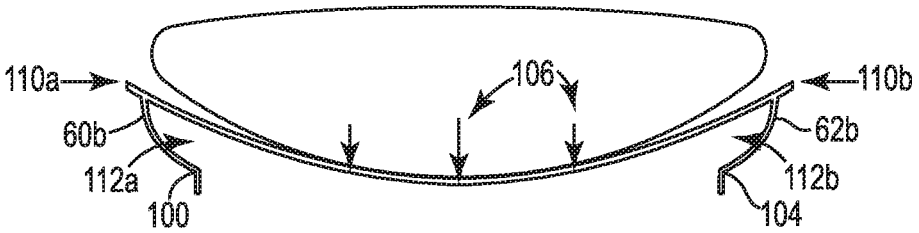

As shown in FIG. 10C, as the user further leans back in the chair 40 and applies more weight, the user's weight, indicated by the arrows at 106, is spread across the back support 64 and the back support 64 further bows under the user's weight. The web portions 60*b* and 62*b* flex inwardly, indicated by arrows at 112*a* and 112*b*, toward the center line 74 of the back support 64 and about the second flex region 100 and the fourth flex region 104. Also, the edges of the first and second flex wings 60 and 62 move further toward the center line 74 of the back 48, indicated by the arrows 110*a* and 110*b* in FIG. 10C.

Figure 10D:
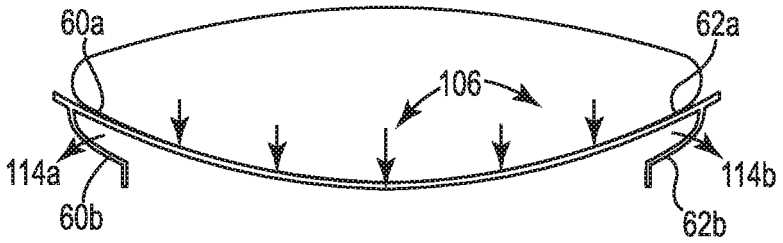

As shown in FIG. 10D, as more of the user's weight is spread over a wider area of the back support 64, indicated by the arrows at 106, the first and second flex wings 60 and 62 flatten out, such that the front portions 60*a* and 62*a* flex or fold toward the web portions 60*b* and 62*b* and the web portions 60*b* and 62*b* flex or fold toward the first and second back uprights 66 and 68, indicated by arrows at 114*a* and 114*b*. Also, the edges of the first and second flex wings 60 and 62 move away from the center line 74 of the back 48 to create more support in the middle of the back support 64. In some embodiments, the front portions 60*a* and 60*b* flex or fold against the web portions 60*b* and 62*b* to arrest further deformation of the first and second flex wings 60 and 62. In some embodiments, the first and second flex wings 60 and 62 experience flexing at the flex regions 98, 100, 102, and 104 and deformation throughout the web portions 60*b* and 62*b*. In some embodiments, the flex regions 98, 100, 102, and 104 are reinforced against deformation such that the web portions 60*b* and 62*b* deform more than the flex regions 98, 100, 102, and 104 or substantially all of the deformation is in the web portions 60*b* and 62*b*.

Figure 11:
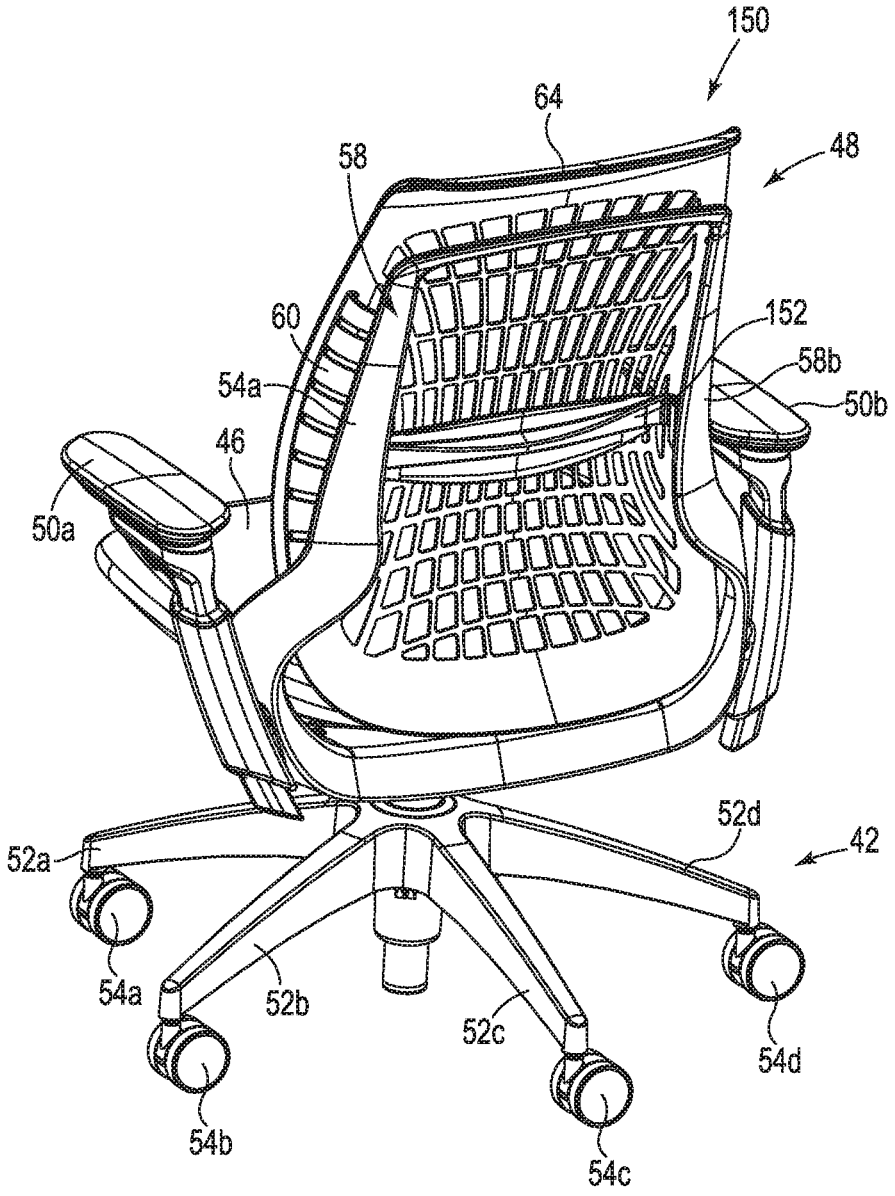
FIG. 11 is a diagram illustrating a perspective view from the back of a chair including a lumbar support member, according to some embodiments.

FIG. 11 is a diagram illustrating a perspective view from the back of a chair 150 including a lumbar member also referred to herein as a lumbar support member 152, according to some embodiments. The chair 150 is similar to the chair 40, with the exception that the chair 150 includes the lumbar support member 152.

The chair 150 includes the same or similar components as the chair 40 such that like numerals point to like components and the description above of the chair 40 applies to the components of the chair 150. For reference, the chair 150 includes the base 42, the hub 44, the seat 46, the back 48, and the armrests 50*a* and 50*b*, where the base 42 supports the chair 150, including the hub 44, the seat 46, and the back 48, on the surface. Also, the base 42 includes the leg supports 52*a*-52*e*, where each of the leg supports 52*a*-52*e* includes the corresponding wheel 54*a*-54*e* for rolling the chair 40 on the surface. The seat 46 supports the body of the user and the armrests 50*a* and 50*b* support the arms of the user.

The back 48 supports the back of the user and flexes or bends to accommodate movements of the user. The back 48 includes the upright frame 58, the first and second flex wings 60 and 62, and the back support 64. The upright frame 58 is supported by the base 42 and includes the first frame side 58*a* and the second frame side 58*b*. The back support 64 is attached to the upright frame 58 at the first frame side 58*a* and the second frame side 58*b* via the first and second flex wings 60 and 62. The first flex wing 60 is situated between the first frame side 58*a* and the back support 64 and the second flex wing 62 is situated between the second frame side 58*b* and the back support 64.

The lumbar support member 152 provides localized support to the back support 64, such as in the lower back region of the user. The lumbar support member 152 is slidably engaged between the first frame side 58*a* and the second frame side 58*b* to slide vertically upward and downward and locally adjust support along the back 48. In some embodiments, the lumbar support member 152 includes a pad to engage the back support 64 and provide forward pressure on the back support 64 to further support the back of the user.

Figure 12:
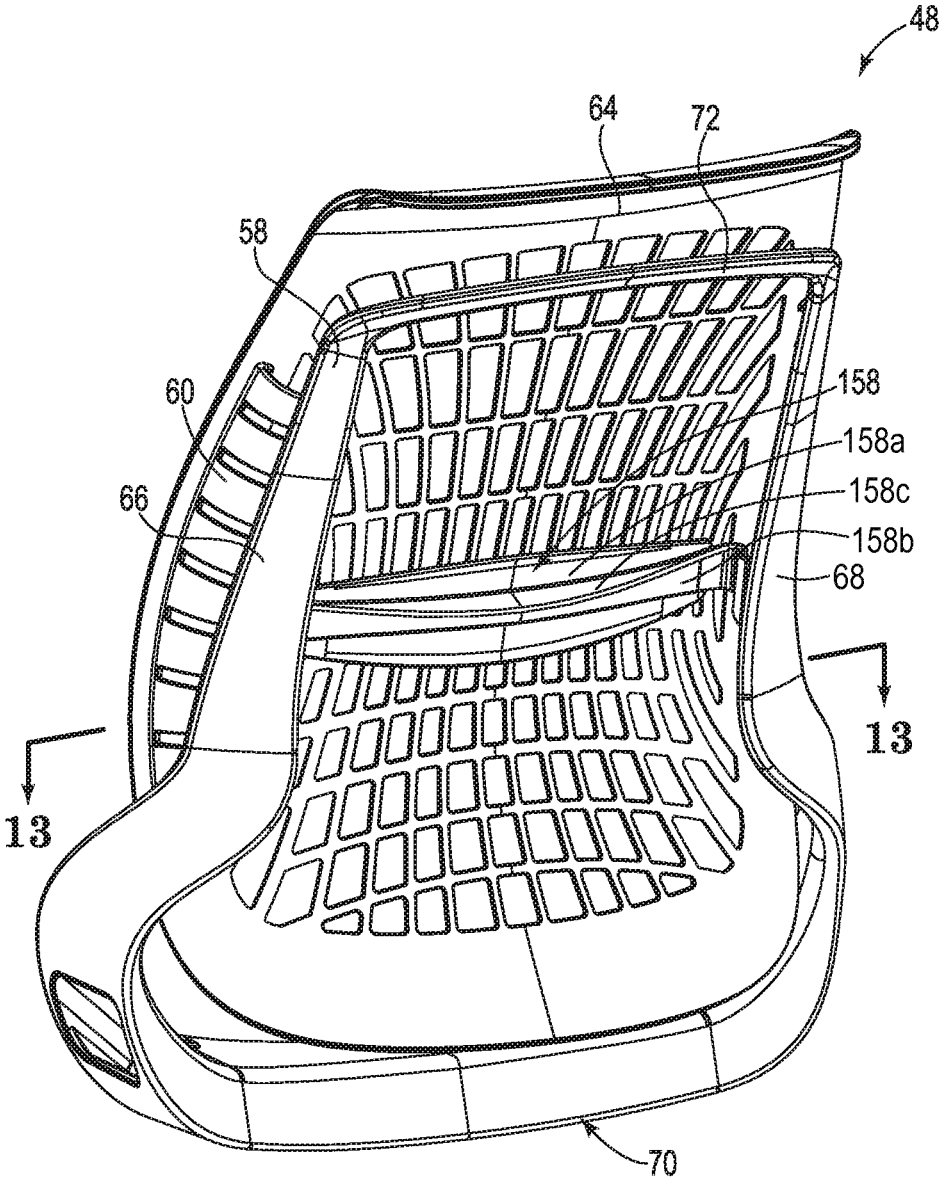
FIG. 12 is a diagram illustrating a perspective view of the back of FIG. 4 including a lumbar support member, according to some embodiments.

FIG. 12 is a diagram illustrating a perspective view of the back 48 including the lumbar support member 152, according to some embodiments. The back 48 includes the upright frame 58, the first and second flex wings 60 and 62, and the back support 64. In some embodiments, the upright frame 58 includes the first back upright 66, the second back upright 68, the bottom transverse member 70, and the top transverse member 72.

The lumbar support member 152 is slidably engaged between the first back upright 66 and the second back upright 68 to slide vertically upward and downward and locally adjust support along the back 48. In some embodiments, the lumbar support member 152 is slidably engaged with the first back upright 66 and the second back upright 68. In some embodiments, the lumbar support member 152 is slidably engaged with the first flex wing 60 and the second flex wing 62.

Figure 13:
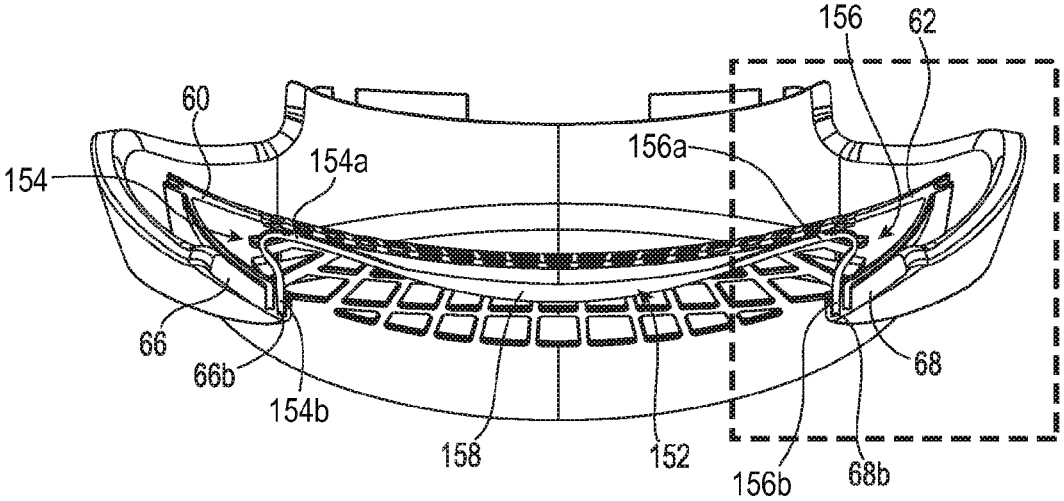
FIG. 13 is a diagram illustrating a cross-section view taken along the line 13-13 in FIG. 12, according to some embodiments.
Figure 14:
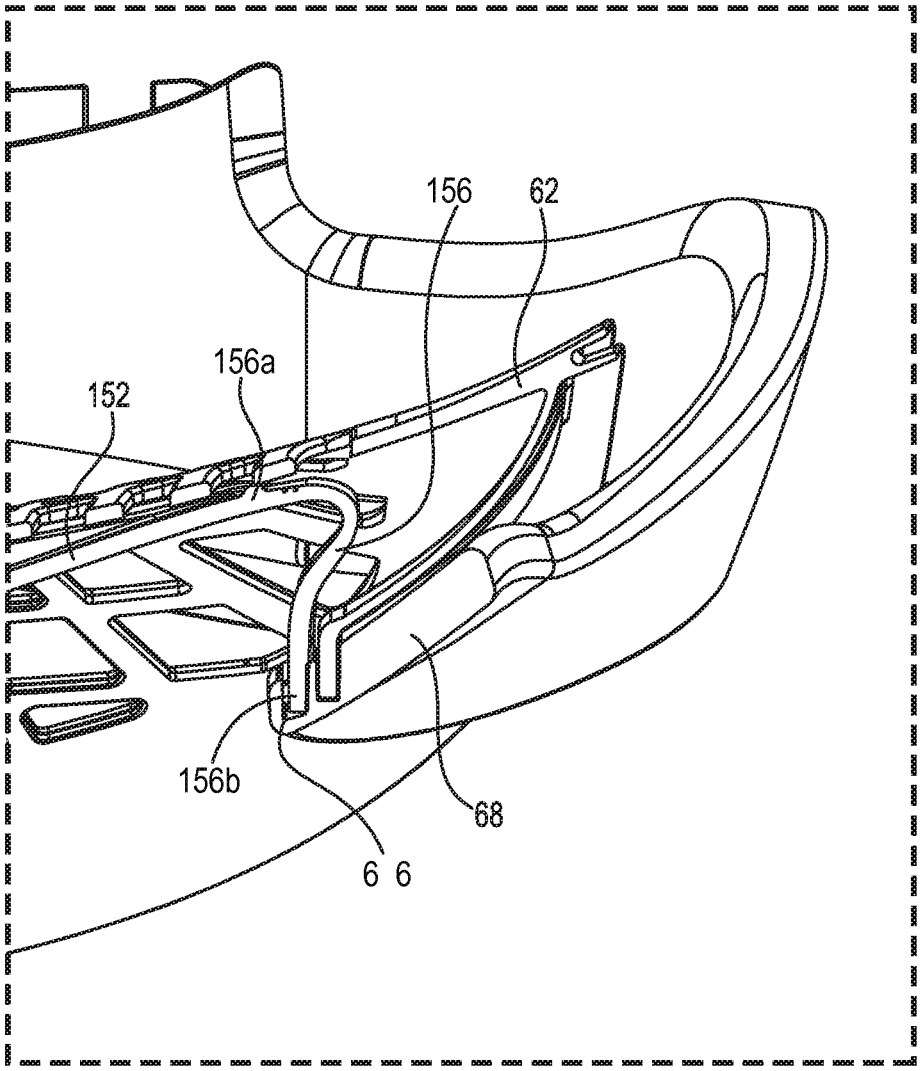
FIG. 14 is a diagram illustrating an enlarged view of one side of the back of FIG. 13, according to some embodiments.

FIGS. 13 and 14 are diagrams illustrating the lumbar support member 152 slidably engaged with the first back upright 66 and the second back upright 68, according to some embodiments described in the disclosure. FIG. 13 is a diagram illustrating a cross-section view taken along the line 13-13 in FIG. 12, according to some embodiments. FIG. 14 is a diagram illustrating an enlarged view of one side of the back 48 as indicated in FIG. 13, according to some embodiments.

Figure 15:
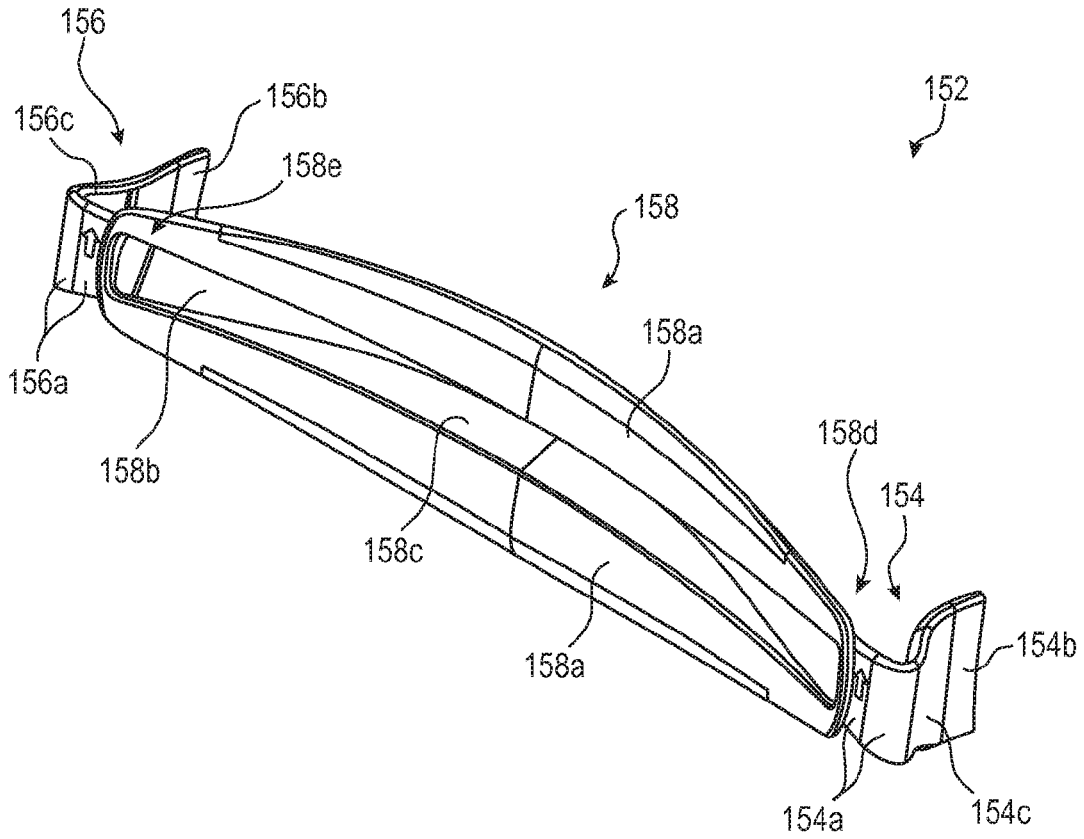
FIG. 15 is a diagram illustrating a front perspective view of a lumbar support member, according to some embodiments.
Figure 16:
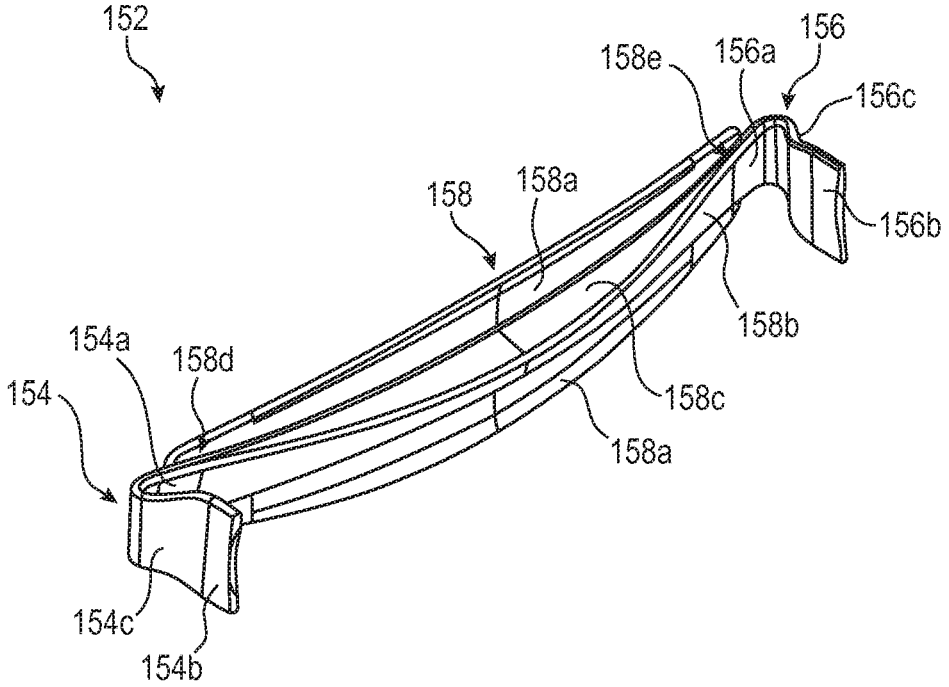
FIG. 16 is a diagram illustrating a rear perspective view of the lumbar support member of FIG. 15, according to some embodiments.

Also, FIGS. 15 and 16 are diagrams illustrating the lumbar support member 152, according to some embodiments described in the disclosure. FIG. 15 is a diagram illustrating a front perspective view of the lumbar support member 152, according to some embodiments. FIG. 16 is a diagram illustrating a rear perspective view of the lumbar support member 152, according to some embodiments.

Referring to FIGS. 12-16, the lumbar support member 152 includes a first flex member 154, a second flex member 156, and a central crossbar member 158. In some embodiments, the first flex member 154, the second flex member 156, and the central crossbar member 158 are integrally formed, i.e., as a single, monolithic piece. In some embodiments, the first flex member 154, the second flex member 156, and the central crossbar member 158 are integrally formed in the same manufacturing process step. In some embodiments, the first flex member 154, the second flex member 156, and the central crossbar member 158 are formed of a resilient flexible material, such as a molded plastic. In some embodiments, two or more of the first flex member 154, the second flex member 156, and the central crossbar member 158 are separate pieces attached together, such as with one or more of adhesives, welding, fasteners, and mechanical engagement.

The first flex member 154 includes a first front portion 154*a*, a first back portion 154*b*, and a first web portion 154*c* that interconnects the first front portion 154*a* and the first back portion 154*b*. In some embodiments, the first front portion 154*a*, the first back portion 154*b*, and the first web portion 154*c* are integrally formed, i.e., as a single, monolithic piece. In some embodiments, the first front portion 154*a*, the first back portion 154*b*, and the first web portion 154*c* are integrally formed in the same manufacturing process step. In some embodiments, the first front portion 154*a*, the first back portion 154*b*, and the first web portion 154*c* are formed of a resilient flexible material, such as a molded plastic. In some embodiments, two or more of the first front portion 154*a*, the first back portion 154*b*, and the first web portion 154*c* are separate pieces attached together, such as with one or more of adhesives, welding, fasteners, and mechanical engagement.

The second flex member 156 includes a second front portion 156*a*, a second back portion 156*b*, and a second web portion 156*c* that interconnects the second front portion 156*a* and the second back portion 156*b*. In some embodiments, the second front portion 156*a*, the second back portion 156*b*, and the second web portion 156*c* are integrally formed, i.e., as a single, monolithic piece. In some embodiments, the second front portion 156*a*, the second back portion 156*b*, and the second web portion 156*c* are integrally formed in the same manufacturing process step. In some embodiments, the second front portion 156*a*, the second back portion 156*b*, and the second web portion 156*c* are formed of a resilient flexible material, such as a molded plastic. In some embodiments, two or more of the second front portion 156*a*, the second back portion 156*b*, and the second web portion 156*c* are separate pieces attached together, such as with one or more of adhesives, welding, fasteners, and mechanical engagement.

The central crossbar member 158 is curved to fit the contour of the back of the user. The central crossbar member 158 includes a first curved crossbar portion 158*a*, a second curved crossbar portion 158*b*, and a crossbar support member 158*c*. The first curved crossbar portion 158*a* is connected to the second curved crossbar portion 158*b* by the crossbar support member 158*c* that is perpendicular or substantially perpendicular to the first curved crossbar portion 158*a* and the second curved crossbar portion 158*b*. The first curved crossbar portion 158*a* supports the back of the user and the second curved crossbar portion 158*b* with the crossbar support member 158*c* adds structural support to the first curved crossbar portion 158*a*. In some embodiments, the first curved crossbar portion 158*a*, the second curved crossbar portion 158*b*, and the crossbar support member

158*c* are integrally formed, i.e., as a single, monolithic piece. In some embodiments, the first curved crossbar portion 158*a*, the second curved crossbar portion 158*b*, and the crossbar support member 158*c* are integrally formed in the same manufacturing process step. In some embodiments, the first curved crossbar portion 158*a*, the second curved crossbar portion 158*b*, and the crossbar support member 158*c* are formed of a resilient flexible material, such as a molded plastic. In some embodiments, two or more of the first curved crossbar portion 158*a*, the second curved crossbar portion 158*b*, and the crossbar support member 158*c* are separate pieces attached together, such as with one or more of adhesives, welding, fasteners, and mechanical engagement.

The central crossbar member 158 further includes a first crossbar member end 158*d* and a second crossbar member end 158*e*, as shown in FIGS. 15 and 16. The first flex member 154 is connected to the first crossbar member end 158*d* and the second flex member 156 is connected to the second crossbar member end 158*e*. In some embodiments, the first front portion 154*a* is connected to the first crossbar member end 158*d* and the second front portion 156*a* is connected to the second crossbar member end 158*e*.

The first back upright 66 includes a first lumbar track 66*b* for receiving the first back portion 154*b* of the first flex member 154 and the second back upright 68 includes a second lumbar track 68*b* for receiving the second back portion 156*b* of the second flex member 156. The first back portion 154*b* is inserted in and slidably engaged in the first lumbar track 66*b* and the second back portion 156*b* is inserted in and slidably engaged in the second lumbar track 68*b*. The lumbar support member 152 extends between the first back upright 66 and the second back upright 68 to flex and provide local resistance to compression of the first flex wing 60 and the second flex wing 62. In addition, the lumbar support member 152 slides vertically upward and downward to locally adjust support along the back 48. In some embodiments, the lumbar support member 152 further includes a pad to engage the back support 64 and provide forward pressure on the back support 64. In some embodiments, the lumbar support member 152 is slidably engaged with the first back upright 66 and the second back upright 68 similar to the way that the lumbar support member 242 is slidably engaged with the upright frame 244 shown in FIG. 21.

In some embodiments, the first flex wing 60 includes a first lumbar track for receiving the first back portion 154*b* of the first flex member 154 and the second flex wing 62 includes a second lumbar track for receiving the second back portion 156*b* of the second flex member 156. The first back portion 154*b* is inserted in and slidably engaged in the first lumbar track of the first flex wing 60 and the second back portion 156*b* is inserted in and slidably engaged in the second lumbar track of the second flex wing 62. The lumbar support member 152 extends between the first flex wing 60 and the second flex wing 62 to flex and provide local resistance to compression of the first flex wing 60 and the second flex wing 62. In addition, the lumbar support member 152 slides vertically upward and downward to locally adjust support along the back 48. In some embodiments, the lumbar support member 152 further includes a pad to engage the back support 64 and provide forward pressure on the back support 64. In some embodiments, the lumbar support member 152 is slidably engaged with the first flex wing 60 and the second flex wing 62 similar to the way that the lumbar support member 202 is slidably engaged with the flex wing 204 shown in FIG. 20.

In some embodiments, the lumbar support member 152 does not include the central crossbar member 158, such that the lumbar support member 152 includes the first flex member 154 and the second flex member 156 without the interconnecting central support region 158. In these embodiments, the first flex member 154 is inserted in and slidably engaged in a first lumbar track in one of the first back upright 66 and the first flex wing 60 to flex and provide local resistance to compression of the first flex wing 60, and the second flex member 156 is inserted in and slidably engaged in a second lumbar track in one of the second back upright 68 and the second flex wing 62 to flex and provide local resistance to compression of the second flex wing 62.

Figure 17:
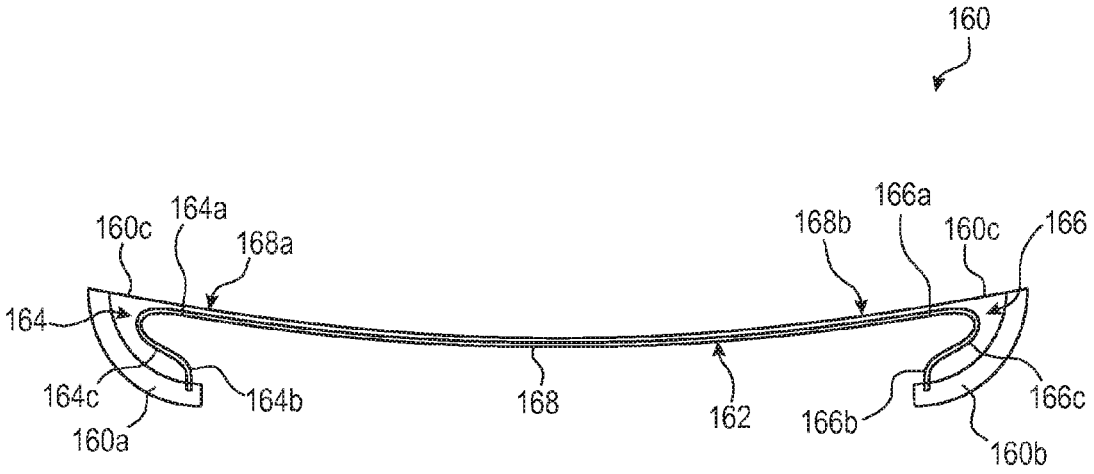
FIG. 17 is a diagram illustrating a cross-section of a mesh back chair including a lumbar support member, according to some embodiments.

FIG. 17 is a diagram illustrating a cross-section of a mesh back chair 160 including a lumbar support member 162, according to some embodiments described in the disclosure. The mesh back chair 160 includes a first back frame 160*a*, a second back frame 160*b*, and a mesh material 160*c* tensioned across the back of the chair from the first back frame 160*a* to the second back frame 160*b*. The lumbar support member 162 extends between the first back frame 160*a* and the second back frame 160*b* behind the mesh material 160*c* to support the back of the user.

The lumbar support member 162 includes a first flex member 164, a second flex member 166, and a central crossbar member 168. In some embodiments, the first flex member 164, the second flex member 166, and the central crossbar member 168 are integrally formed, i.e., as a single, monolithic piece. In some embodiments, the first flex member 164, the second flex member 166, and the central crossbar member 168 are integrally formed in the same manufacturing process step. In some embodiments, the first flex member 164, the second flex member 166, and the central crossbar member 168 are formed of a resilient flexible material, such as a molded plastic. In some embodiments, two or more of the first flex member 164, the second flex member 166, and the central crossbar member 168 are separate pieces attached together, such as with one or more of adhesives, welding, fasteners, and mechanical engagement.

The first flex member 164 includes a first front portion 164*a*, a first back portion 164*b*, and a first web portion 164*c* that interconnects the first front portion 164*a* and the first back portion 164*b*. In some embodiments, the first front portion 164*a*, the first back portion 164*b*, and the first web portion 164*c* are integrally formed, i.e., as a single, monolithic piece. In some embodiments, the first front portion 164*a*, the first back portion 164*b*, and the first web portion 164*c* are integrally formed in the same manufacturing process step. In some embodiments, the first front portion 164*a*, the first back portion 164*b*, and the first web portion 164*c* are formed of a resilient flexible material, such as a molded plastic. In some embodiments, two or more of the first front portion 164*a*, the first back portion 164*b*, and the first web portion 164*c* are separate pieces attached together, such as with one or more of adhesives, welding, fasteners, and mechanical engagement.

The second flex member 166 includes a second front portion 166*a*, a second back portion 166*b*, and a second web portion 166*c* that interconnects the second front portion 166*a* and the second back portion 166*b*. In some embodiments, the second front portion 166*a*, the second back portion 166*b*, and the second web portion 166*c* are integrally formed, i.e., as a single, monolithic piece. In some embodiments, the second front portion 166*a*, the second back portion 166*b*, and the second web portion 166*c* are integrally formed in the same manufacturing process step. In some embodiments, the second front portion 166*a*, the second back portion 166*b*, and the second web portion 166*c* are formed of a resilient flexible material, such as a molded plastic. In some embodiments, two or more of the second front portion 166*a*, the second back portion 166*b*, and the second web portion 166*c* are separate pieces attached together, such as with one or more of adhesives, welding, fasteners, and mechanical engagement.

The central crossbar member 168 is curved to fit and support the contour of the back of the user. The central crossbar member 168 includes a first crossbar member end 168*a* and a second crossbar member end 168*b*. In some embodiments, the central crossbar member 168 including the first crossbar member end 168*a* and the second crossbar member end 168*b* is integrally formed, i.e., as a single, monolithic piece. In some embodiments, the central crossbar member 168 including the first crossbar member end 168*a* and the second crossbar member end 168*b* is integrally formed in the same manufacturing process step. In some embodiments, the central crossbar member 168 including the first crossbar member end 168*a* and the second crossbar member end 168*b* is formed of a resilient flexible material, such as a molded plastic. In some embodiments, at least one of the first crossbar member end 168*a* and the second crossbar member end 168*b* are separate pieces attached together, such as with one or more of adhesives, welding, fasteners, and mechanical engagement.

The first flex member 164 is connected to the first crossbar member end 168*a* and the second flex member 166 is connected to the second crossbar member end 168*b*. In some embodiments, the first front portion 164*a* is connected to the first crossbar member end 168*a* and the second front portion 166*a* is connected to the second crossbar member end 168*b*.

In some embodiments, the first back frame 160*a* includes a first lumbar track for receiving the first back portion 164*b* of the first flex member 164 and the second back frame 160*b* includes a second lumbar track for receiving the second back portion 166*b* of the second flex member 166. The first back portion 164*b* is inserted in and slidably engaged in the first lumbar track and the second back portion 166*b* is inserted in and slidably engaged in the second lumbar track. The lumbar support member 162 slides vertically upward and downward to locally adjust support along the back of the chair 160. The lumbar support member 162 extends between the first back frame 160*a* and the second back frame 160*b* to flex and provide local support to the lower back region of the user. In some embodiments, the lumbar support member 162 further includes a pad to engage the mesh material 160*c* and provide forward pressure on the mesh material 160*c*. In some embodiments, the lumbar support member 162 is slidably engaged with the first back frame 160*a* and the second back frame 160*b* similar to the way that the lumbar support member 242 is slidably engaged with the upright frame 244 shown in FIG. 21.

FIGS. 18A-18D are diagrams illustrating the flexing action of the lumbar support member 152 shown in FIGS. 11-16, including the flexing action of the first flex member 154 and the second flex member 156, according to some embodiments. In some embodiments, the lumbar support member 162 shown in FIG. 17, including the first flex member 164 and the second flex member 166, has a flexing action that is similar to the flexing action of the lumbar support member 152 shown in FIGS. 11-16.

Figure 18A:
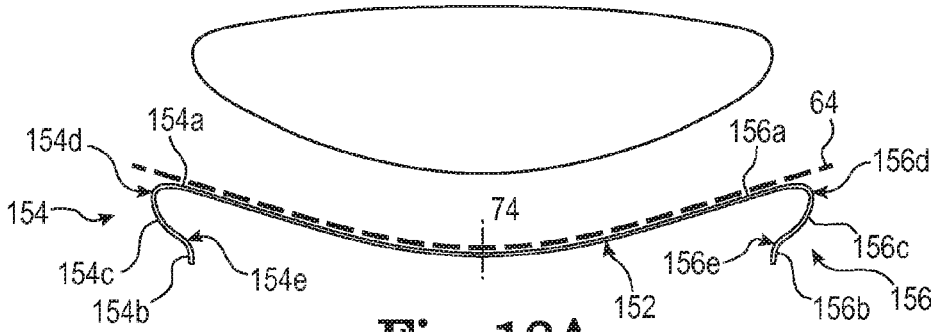
FIGS. 18A-18D are diagrams illustrating the flexing action of the lumbar support member that is shown in FIGS. 11-16, according to some embodiments.

The first flex member 154 and the second flex member 156 flex in response to a user leaning back in the chair 40 and applying weight to the back support 64. As shown in FIG. 18A, the first flex member 154 includes a first flex region 154*d* defined by the first front portion 154*a* and the first web portion 154*c*, and a second flex region 154*e* defined by the first web portion 154*c* and the first back portion 154*b*. The second flex member 156 includes a third flex region 156*d* defined by the second front portion 156*a* and the second web portion 156*c*, and a fourth flex region 156*e* defined by the second web portion 156*c* and the second back portion 156*b*. In some embodiments, the first and second web portions 154*c* and 156*c* extend away from the first and second front portions 154*a* and 156*a*, respectively, at an acute angle. In some embodiments, the first and second web portions 154*c* and 156*c* extend away from the first and second front portions 154*a* and 156*a*, respectively, at an angle in the range of 20-80 degrees. In some embodiments, the first and second web portions 154*c* and 156*c* extend away from the first and second back portions 154*b* and 156*b*, respectively, at an obtuse angle. In other embodiments, the first and second web portions 154*c* and 156*c* extend away from the first and second back portions 154*b* and 156*b*, respectively, at an acute angle.

Figure 18B:
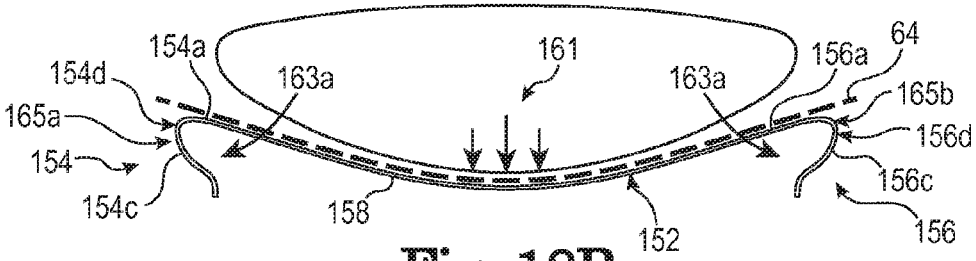

As shown in FIG. 18B, as the user's weight, indicated by arrows at 161, presses on the central crossbar member 158, the front portions 154*a* and 156*a* flex inwardly, indicated by arrows at 163*a* and 163*b*, toward the web portions 154*c* and 156*c* and about the first flex region 154*d* and the third flex region 156*d*. Also, edges of the first and second flex members 154 and 156 move toward the center line 74 of the back 48, indicated by arrows 165*a* and 165*b*. In some embodiments, a concentrated center load flexes the first and second flex members 154 and 156 such that the lumbar support 152 embraces the user.

Figure 18C:
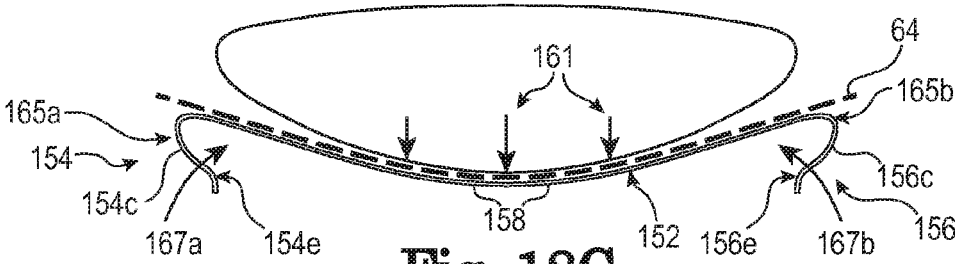

As shown in FIG. 18C, as the user applies more weight, the user's weight, indicated by the arrows at 161, is spread across the central crossbar member 158 and the first and second web portions 154*c* and 156*c* flex inwardly, indicated by arrows at 167*a* and 167*b*, toward the center line 74 of the back support 64 and about the second flex region 154*e* and the fourth flex region 156*e*. Also, the edges of the first and second flex members 154 and 156 move further toward the center line 74 of the back 48, indicated by the arrows 165*a* and 165*b* in FIG. 18C.

Figure 18D:
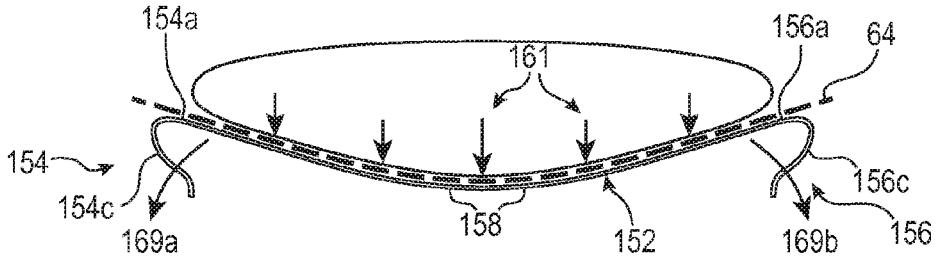

As shown in FIG. 18D, as more of the user's weight is spread over a wider area of central crossbar member 158, indicated by the arrows at 161, the first and second flex members 154 and 156 flatten out, such that the first and second front portions 154*a* and 156*a* flex or fold toward the first and second web portions 154*c* and 156*c*, and the first and second web portions 154*c* and 156*c* flex or fold toward the first and second back uprights 66 and 68, indicated by arrows at 169*a* and 169*b*. Also, the edges of the first and second flex members 154 and 156 move away from the center line 74 of the back 48 to create more support in the middle of the back support 64. In some embodiments, the first and second front portions 154*a* and 154*b* flex or fold against the first and second web portions 154*c* and 156*c* to arrest further deformation of the first and second flex members 154 and 156. In some embodiments, the first and second flex members 154 and 156 experience flexing at the flex regions 154*d*, 154*e*, 156*d*, and 156*e* and deformation throughout the first and second web portions 154*c* and 156*c*. In some embodiments, the flex regions 154*d*, 154*e*, 156*d*, and 156*e* are reinforced against deformation such that the first and second web portions 154*c* and 156*c* deform more than the flex regions 154*d*, 154*e*, 156*d*, and 156*e* or substantially all of the deformation is in the first and second web portions 154*c* and 156*c*.

Figure 19:
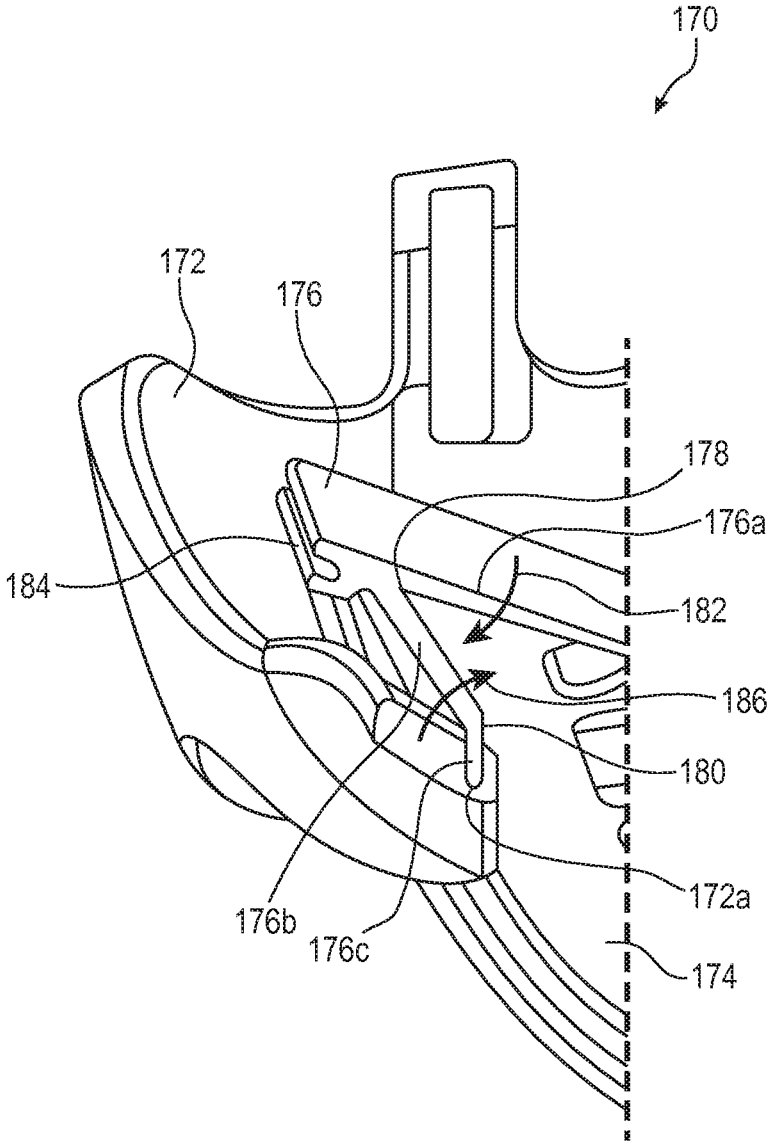
FIG. 19 is a diagram illustrating an enlarged cross-section view of one side of a back that includes a Y-shaped flex wing, according to some embodiments.

FIG. 19 is a diagram illustrating an enlarged cross-section view of one side of a back 170 that includes an upright frame 172, a back support 174, and a flex wing 176, according to some embodiments. The flex wing 176 is one flex wing of a pair of flex wings similar to the first and second flex wings 60 and 62, with the exception that the flex wing 176 and its pair have different shapes than the first and second flex wings 60 and 62. The flex wing 176 and its pair are mirror images of each other, but otherwise similar, such that they can both be described with reference to the flex wing 176.

The flex wing 176 is similar to each of the first and second flex wings 60 and 62, except for the shape, such that the description provided above for the first and second flex wings 60 and 62 applies to the flex wing 176. Also, the back 170 is similar to the back 48, the upright frame 172 is similar to the upright frame 58, and the back support 174 is similar to the back support 64, such that the description provided above for the back 48, the upright frame 58, and the back support 64 applies to the back 170, the upright frame 172, and the back support 174.

The flex wing 176 is a Y-shaped or, alternatively, lambda-shaped resilient piece that flexes as user weight is applied to the back support 174. The flex wing 176 includes a front portion 176*a*, a web portion 176*b*, and a back portion 176*c*, where the web portion 176*b* is straighter than each of the web portions 60*b* and 62*b* of the first and second flex wings 60 and 62.

The flex wing 176 and its pair secure the back support 174 to the upright frame 172. The front portion 176*a* is attached to or part of the back support 174 and the back portion 176*c* is inserted in and secured to a receiving channel 172*a* of the upright frame 172.

The flex wing 176 flexes in response to the weight of a user. The flex wing 176 includes a first flex region 178 defined by the front portion 176*a* and the web portion 176*b* and a second flex region 180 defined by the web portion 176*b* and the back portion 176*c*. In some embodiments, the web portion 176*b* extends away from the front portion 176*a* at an acute angle. In some embodiments, the web portion 176*b* extends away from the front portion 176*a* at an angle in the range of 20-80 degrees. In some embodiments, the web portion 176*b* extends away from the back portion 176*c* at an obtuse angle. In other embodiments, the web portion 176*b* extends away from the back portion 176*c* at an acute angle.

The flex wing 176 flexes in response to a user leaning back and applying weight to the back support 174. The flex wing 176 flexes similar to the first and second flex wings 60 and 62 as described in reference to FIGS. 10A-10D. Initially, as the back support 174 bows under user weight, the front portion 176*a* flexes inwardly, indicated by an arrow at 182, toward the web portion 176*b* and about the first flex region 178. Also, the edge 184 of the flex wing 176 moves toward the center of the back 170.

Next, as the user further leans back and applies more weight, the user's weight is spread across the back support 174 and the back support 174 bows further under the user's weight. The web portion 176*b* flexes inwardly, indicated by the arrow 186, toward the center of the back support 174 and about the second flex region 180. Also, the edge 184 of the flex wing 176 moves further toward the center of the back 170.

Next, as more of the user's weight is spread over a wider area of the back support 174, the flex wing 176 flattens out, such that the front portion 176*a* flexes or folds toward the web portion 176*b* and the web portion 176*b* flexes or folds toward the back support 174 and the upright frame 58. Also, the edge 184 of the flex wing 176 moves away from the center of the back 170 to create more support in the middle of the back support 174.

Figure 20:
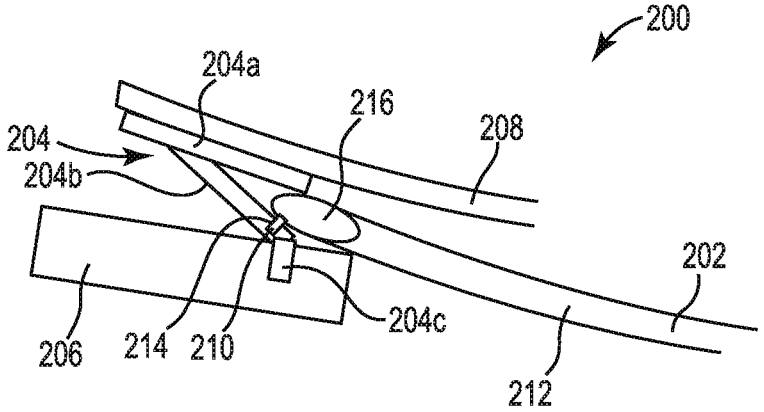
FIG. 20 is a diagram illustrating one side of a back that includes a lumbar support member slidably engaged with a flex wing, according to some embodiments.

FIG. 20 is a diagram illustrating one side of a back 200 that includes a lumbar support member 202 slidably engaged with a flex wing 204 to slide vertically upward and downward on the back 200, according to some embodiments. Also, the lumbar support member 202 locally limits further compression of the flex wing 204, after the flex wing 204 has been sufficiently flexed. The back 200 includes the lumbar support member 202, the flex wing 204, an upright frame 206, and a back support 208.

The one side of the back 200 that is shown in FIG. 20 is a mirror image of the other side of the back 200, but otherwise similar, such that they can both be described with reference to the one side of the back 200 shown in FIG. 20. Also, the flex wing 204 is one of a pair of flex wings that are mirror images of each other, but otherwise similar, such that they can both be described with reference to the flex wing 204. In addition, an end 210 of the lumbar support member 202 is one of a pair of ends of the lumbar support member 202, which are mirror images of each other, but otherwise similar, such that they can both be described with reference to the one end 210.

In some embodiments, the back 200 is similar to the back 48, the flex wing 204 is similar to each of the first and second flex wings 60 and 62, the upright frame 206 is similar to the upright frame 58, and the back support 208 is similar to the back support 64, such that the description provided above for the back 48, the first and second flex wings 60 and 62, the upright frame 58, and the back support 64 applies to the back 200, the flex wing 204, the upright frame 206, and the back support 208. In some embodiments, the lumbar support member 202 is similar to the lumbar support member 152. In some embodiments, the lumbar support member 202 is similar to the lumbar support member 162.

The lumbar support member 202 includes the end 210 and a central support region 212. The flex wing 204 includes a front portion 204*a*, a web portion 204*b*, and a back portion 204*c*. In addition, the flex wing 204 includes a lumbar track 214 for receiving the end 210 of the lumbar support member 202. The end 210 is inserted in and slidably engaged in the lumbar track 214. The lumbar support member 202 slides vertically upward and downward in the lumbar track 214 to locally adjust support along the back 200.

In some embodiments, the lumbar support member 202 further includes a protrusion 216 that extends from the lumbar support member 202 to between the front portion 204*a* and the web portion 204*b* of the flex wing 204. As the front portion 204*a* flexes toward the web portion 204*b*, the protrusion 216 interferes with the flexure of the front portion 204*a* and the web portion 204*b* to limit further compression of the flex wing 204.

Figure 21:
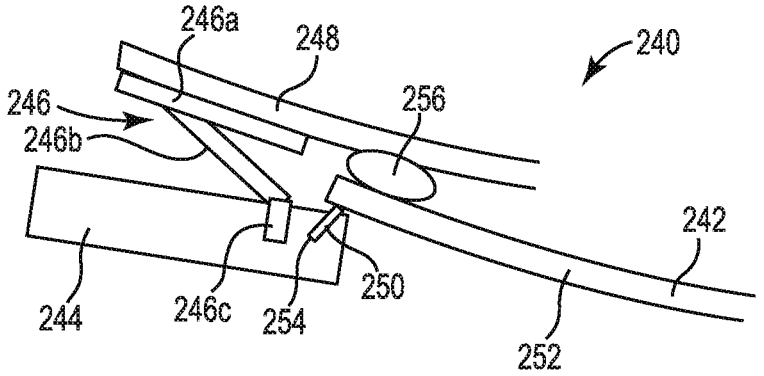
FIG. 21 is a diagram illustrating one side of a back that includes a lumbar support member slidably engaged with an upright frame, according to some embodiments.

FIG. 21 is a diagram illustrating one side of a back 240 that includes a lumbar support member 242 slidably engaged with an upright frame 244 to slide vertically upward and downward on the back 240, according to some embodiments. The lumbar support member 242 locally limits further compression of the flex wings including flex wing 246, after the flex wing 246 has been sufficiently flexed. The back 240 includes the lumbar support member 242, the upright frame 244, the flex wing 246, and a back support 248.

The one side of the back 240 that is shown in FIG. 21 is a mirror image of the other side of the back 240, but otherwise similar, such that they can both be described with reference to the one side of the back 240 shown in FIG. 21. Also, the flex wing 246 is one of a pair of flex wings that are mirror images of each other, but otherwise similar, such that they can both be described with reference to the flex wing 246. In addition, an end 250 of the lumbar support member 242 is one of a pair of ends of the lumbar support member 242, which are mirror images of each other, but otherwise similar, such that they can both be described with reference to the end 250.

In some embodiments, the back 240 is similar to the back 48, the flex wing 246 is similar to each of the first and second flex wings 60 and 62, the upright frame 244 is similar to the upright frame 58, and the back support 248 is similar to the back support 64, such that the description provided above for the back 48, the first and second flex wings 60 and 62, the upright frame 58, and the back support 64 applies to the back 240, the flex wing 246, the upright frame 244, and the back support 248. In some embodiments, the lumbar support member 242 is similar to the lumbar support member 152. In some embodiments, the lumbar support member 242 is similar to the lumbar support member 162.

The lumbar support member 242 includes the end 250 and a central support region 252. The flex wing 246 includes a front portion 246*a*, a web portion 246*b*, and a back portion 246*c*. In addition, the upright frame 244 includes a lumbar track 254 for receiving the end 250 of the lumbar support member 242. The end 250 is inserted in and slidably engaged in the lumbar track 254 of the upright frame 244. The lumbar support member 242 slides vertically upward and downward in the lumbar track 254 to locally adjust support along the back 240.

In some embodiments, the lumbar support member 242 further includes a protrusion 256 that extends from the lumbar support member 242 toward the back support 248. As the front portion 246*a* flexes toward the web portion 246*b*, the protrusion 256 presses against the back support 248 and limits flexure and further compression of the flex wing 246. In some embodiments, the lumbar track is built into the lumbar support member, such as lumbar support member 202 and lumbar support member 242, and a complementary slide feature is built into one of the flex wings and the upright frame.

Figure 22:
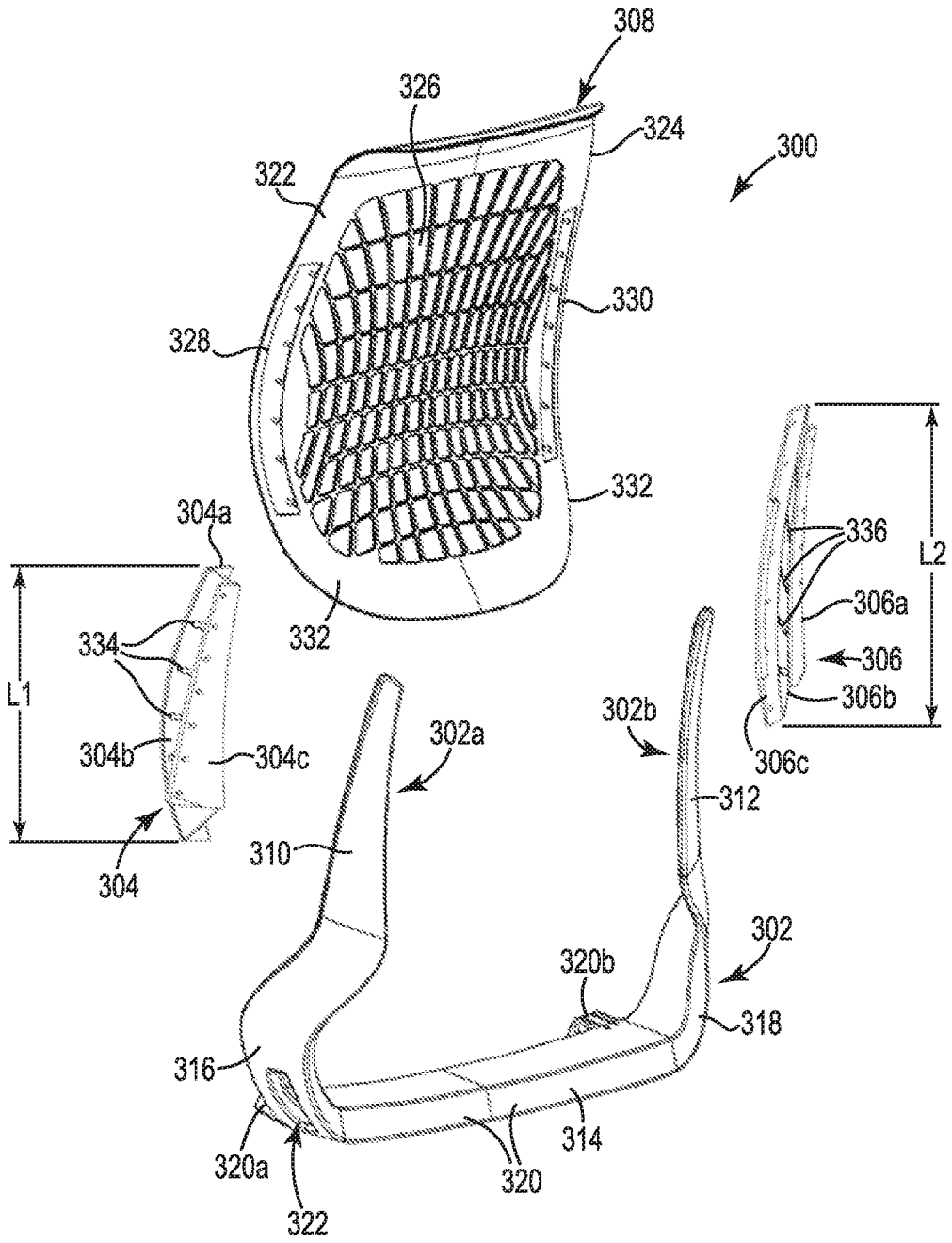
FIG. 22 is a diagram illustrating an exploded view of a back that includes a U-shaped upright frame and Z-shaped first and second flex wings, according to some embodiments.

FIG. 22 is a diagram illustrating an exploded view of a back 300 of a chair that includes a U-shaped upright frame 302 and Z-shaped first and second flex wings 304 and 306, according to some embodiments. The back 300 includes the upright frame 302, the first and second flex wings 304 and 306, and a back support 308. The first and second flex wings 304 and 306 are secured to the upright frame 302 and to the back support 308. The first and second flex wings 304 and 306 secure the back support 308 to the upright frame 302 and flex in response to the weight of a user.

The upright frame 302 is substantially rigid and includes a first back upright 310, a second back upright 312, and a bottom transverse member 314. The upright frame 302 is a U-shaped frame, where the first back upright 310 is substantially rigid and situated at the first frame side 302*a* and the second back upright 312 is substantially rigid and situated at the second frame side 302*b*. In some embodiments, the upright frame 302 is formed from cast aluminum. In some embodiments, the upright frame 302 is formed from molded plastic. In some embodiments, each of the first back upright 310 and the second back upright 312 includes a lumbar support member track for receiving an adjustable lumbar support member.

The bottom transverse member 314 includes first and second corner portions 316 and 318 and a bottom portion 320 that includes frame connectors 320*a* and 320*b*. In some embodiments, the bottom transverse member 314 is substantially rigid and secured to a hub, such as the hub 44, with the frame connectors 320*a* and 320*b*, which secures the upright frame 302 to the hub. In some embodiments, each of the first and second corner portions 316 and 318 includes an arm receiving opening, such as arm receiving opening 322, for engaging and securing armrests, such as the armrests 50*a* and 50*b*, to the upright frame 302.

The first back upright 310 is attached to the second back upright 312 by the bottom transverse member 314, such that the first back upright 310, the second back upright 312, and the bottom transverse member 314 form a U-shaped support. The first back upright 310 is secured to the first corner portion 316 and the second back upright 312 is secured to the second corner portion 318. In some embodiments, the first back upright 310, the second back upright 312, and the bottom transverse member 314 are integrally formed, i.e., as a single, monolithic piece. In some embodiments, the first back upright 310, the second back upright 312, and the bottom transverse member 314 are integrally formed in the same manufacturing process step. In some embodiments, the first back upright 310, the second back upright 312, and the bottom transverse member 314 are molded as a single, monolithic piece. In some embodiments, two or more of the first back upright 310, the second back upright 312, and the bottom transverse member 314 are separate pieces that are secured together, such as with one or more of adhesives, welding, fasteners, and mechanical engagement with each other.

The back support 308 is substantially flexible and has an outer region 324 and a central region 326. The outer region 324 includes a first side portion 328 and a second side portion 330. In some embodiments, the back support 308 is integrally formed, i.e., as a single, monolithic piece. In some embodiments, the back support 308 includes separate pieces that are secured together, such as with one or more of adhesives, welding, fasteners, and mechanical engagement with each other. In some embodiments, the back support 308 is formed of a flexible material, such as a thermoplastic. In some embodiments, the back support 308 is formed of a flexible material, including a thermoplastic elastomer. In some embodiments, the back support 308 is formed of a molded plastic that flexes under the weight of the user. In some embodiments, the back support 308 is formed of a molded thermoplastic.

The outer region 324 defines a perimeter ring 332 and the central region 326 defines a plurality of apertures arranged in a grid pattern that, optionally, increases the flexibility of the back support 308 in the central region 326. The perimeter ring 332 includes the first side portion 328 and the second side portion 330. In some embodiments, the central region 326 includes a mesh material for supporting the user, where the mesh material is attached to the perimeter ring 332. In some embodiments, the back support 308 includes a knit upholstery for supporting the user, where the knit upholstery is attached to the perimeter ring 332. In some embodiments, the back support 308 includes a molded plastic ring carrier at the perimeter ring 332 and a mesh is secured to the molded plastic ring carrier.

The first flex wing 304 is attached to or part of the first side portion 328 and the second flex wing 306 is attached to or part of the second side portion 330. The first flex wing 304 includes first notches 334 defined along the length L1 of the first flex wing 304 and the second flex wing 306 includes second notches 336 defined along the length L2 of the second flex wing 306. The flexibility of the first and second flex wings 304 and 306 can be adjusted based on the number of first and second notches 334 and 336 per unit length. Also, the flexibility of the first and second flex wings 304 and 306 can be adjusted based on the thickness T (see FIG. 23) of the first and second flex wings 304 and 306. In some embodiments, the first and second flex wings 304 and 306 and the back support 308 are integrally formed, i.e., as a single, monolithic piece. In some embodiments the first and second flex wings 304 and 306 and the back support 308 are integrally formed in the same manufacturing process step. In some embodiments, the first and second flex wings 304 and 306 and the back support 308 are molded as a single, monolithic piece. In some embodiments, the first and second flex wings 304 and 306 are separate pieces attached to the back support 308, such as with one or more of adhesives, welding, fasteners, and mechanical engagement with the back support 308.

Figure 23:
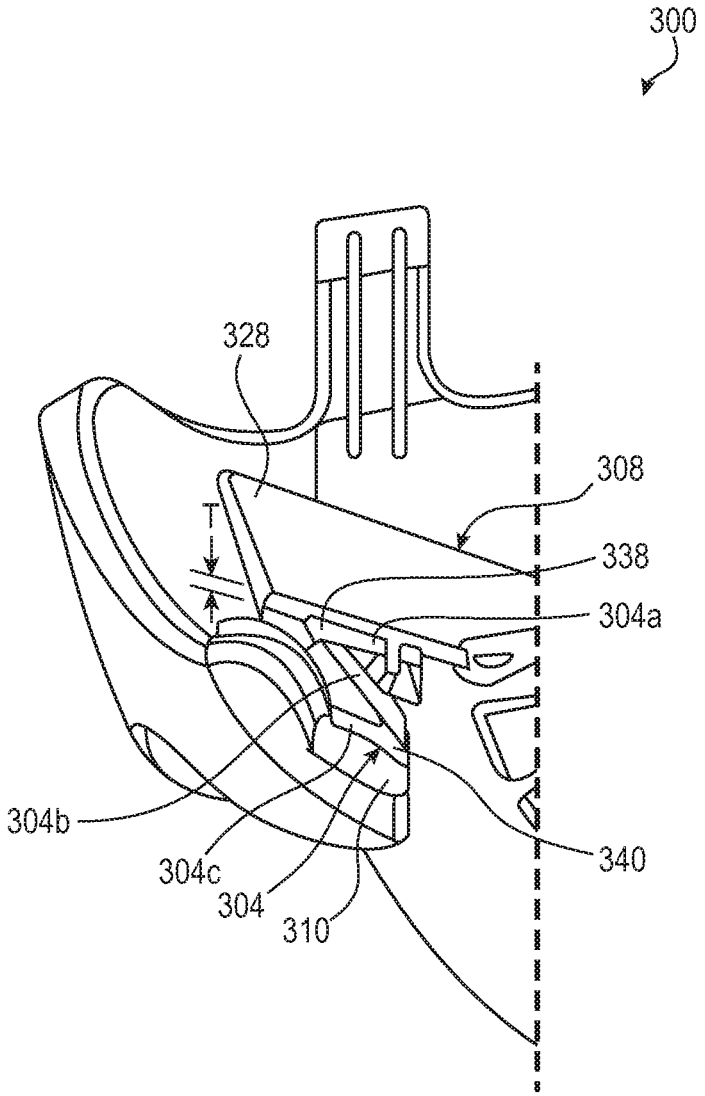
FIG. 23 is an enlarged diagram illustrating a cross-section of one side of the assembled back of FIG. 22, according to some embodiments.

FIG. 23 is an enlarged diagram illustrating a cross-section of one side of the assembled back 300, according to some embodiments. The cross-section of FIG. 23 is taken along a line that intersects the first and second flex wings 304 and 306. The cross-section enlarged diagram of FIG. 23 is similar to the enlarged diagram illustrating one side of the back 48 of FIG. 9. The one side of the back 300 that is shown in FIG. 23 is a mirror image of the other side of the back 300, but otherwise similar, such that both sides can be described with reference to the side of the back 300 shown in FIG. 23. Also, the first and second flex wings 304 and 306 are mirror images of each other, but otherwise similar, such that they can both be described with reference to one of the flex wings 304.

With reference to FIGS. 22 and 23, the first and second flex wings 304 and 306 are each Z-shaped resilient pieces that flex as user weight is applied to the back support 308. The first flex wing 304 includes a first front portion 304*a*, a first web portion 304*b*, and a first back portion 304*c*. The second flex wing 306 includes a second front portion 306*a*, a second web portion 306*b*, and a second back portion 306*c*. In some embodiments, the first front portion 304*a*, the first web portion 304*b*, and the first back portion 304*c* are integrally formed, i.e., as a single, monolithic piece. In some embodiments, the second front portion 306*a*, the second web portion 306*b*, and the second back portion 306*c* are integrally formed, i.e., as a single, monolithic piece. In some embodiments, the first front portion 304*a*, the first web portion 304*b*, and the first back portion 304*c* are integrally formed in the same manufacturing process step. In some embodiments, the second front portion 306*a*, the second web portion 306*b*, and the second back portion 306*c* are integrally formed in the same manufacturing process step. In some embodiments, the first front portion 304*a*, the first web portion 304*b*, and the first back portion 304*c* are formed of a resilient flexible material, such as a molded plastic. In some embodiments, the second front portion 306*a*, the second web portion 306*b*, and the second back portion 306*c* are formed of a resilient flexible material, such as a molded plastic. In some embodiments, two or more of the first front portion 304*a*, the first web portion 304*b*, and the first back portion 304*c* are separate pieces attached together, such as with one or more of adhesives, welding, fasteners, and mechanical engagement. In some embodiments, two or more of the second front portion 306*a*, the second web portion 306*b*, and the second back portion 306*c* are separate pieces attached together, such as with one or more of adhesives, welding, fasteners, and mechanical engagement.

The first and second flex wings 304 and 306 secure the back support 308 to the upright frame 302. The first front portion 304*a* of the first flex wing 304 is attached to or part of the first side portion 328 of the back support 308 and the second front portion 306*a* of the second flex wing 306 is attached to or part of the second side portion 330 of the back support 308. Also, the first back portion 304*c* is secured to the first back upright 310 to secure the first flex wing 304 to the first back upright 310 and the second back portion 306*c* is secured to the second back upright 312 to secure the second flex wing 306 to the second back upright 312.

With reference to FIG. 23, the first flex wing 304 includes a first flex region 338 defined by the first front portion 304*a* and the first web portion 304*b*, and a second flex region 340 defined by the first web portion 304*b* and the first back portion 304*c*. In some embodiments, the first web portion 304*b* extends away from the first front portion 304*a* at an acute angle. In some embodiments, the first web portion 304*b* extends away from the first front portion 304*a* at an angle in the range of 20-80 degrees. In some embodiments, the first web portion 304*b* extends away from the first back portion 304*c* at an acute angle. In some embodiments, the first web portion 304*b* extends away from the first back portion 304*c* at an obtuse angle.

The Z-shaped first and second flex wings 304 and 306 flex in response to the weight of a user similar to the way the Y-shaped first and second flex wings 60 and 62 flex in response to the weight of a user, as described in reference to FIGS. 10A-10D.

Figure 24:
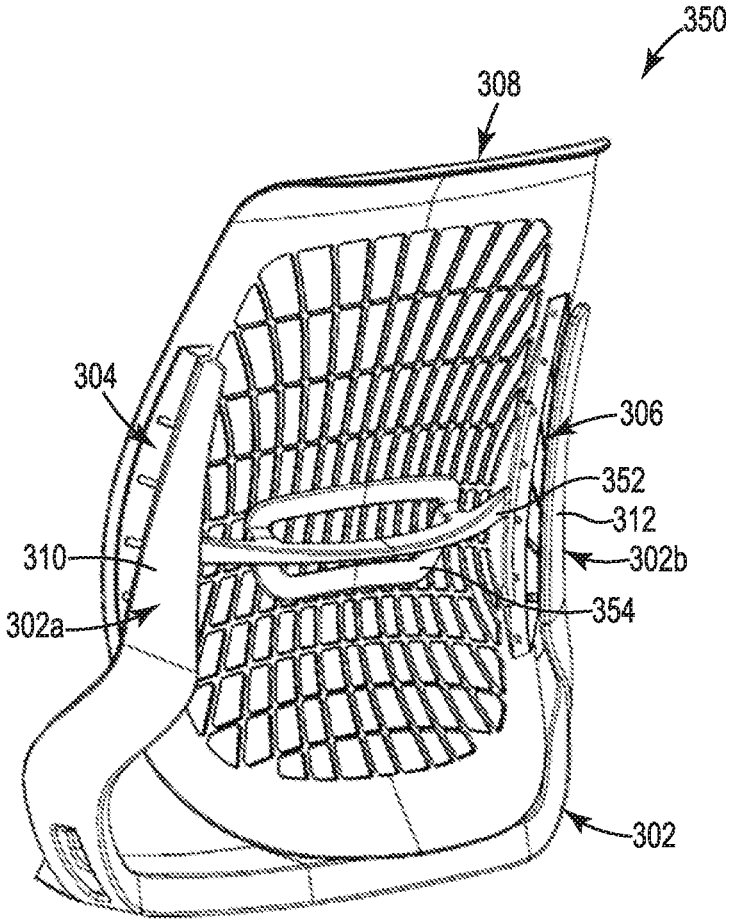
FIG. 24 is a diagram illustrating a perspective view of a back including a lumbar support member, according to some embodiments.

FIG. 24 is a diagram illustrating a perspective view of a back 350 including a lumbar support member 352, according to some embodiments. The back 350 is similar to the back 300, with the exception that the back 350 includes the lumbar support member 352. The back 350 includes the same or similar components as the back 300 such that like numerals point to like components and the description above of the components of the back 300 applies to the components of the back 350.

For reference, the back 350 includes the U-shaped upright frame 302, the Z-shaped first and second flex wings 304 and 306 and the back support 308. The first and second flex wings 304 and 306 are secured to the upright frame 302 and to the back support 308, which secures the back support 308 to the upright frame 302.

The lumbar support member 352 provides localized support to the back support 308, such as in the lower back region of the user. The lumbar support member 352 is slidably engaged between the first frame side 302*a* and the second frame side 302*b* to slide vertically upward and downward and locally adjust support along the back 350. The lumbar support member 352 includes a pad 354 to engage the back support 308 and provide forward pressure on the back support 308 to further support the back of the user.

In some embodiments, the lumbar support member 352 is slidably engaged with the first back upright 310 and the second back upright 312 to slide vertically upward and downward and locally adjust support along the back 350. In some embodiments, the lumbar support member 352 is slidably engaged with the first back upright 310 and the second back upright 312 similar to the way that the lumbar support member 152 is slidably engaged with the first back upright 66 and the second back upright 68 as shown in FIGS. 13 and 14. In some embodiments, the lumbar support member 352 is slidably engaged with the first back upright 310 and the second back upright 312 similar to the way that the lumbar support member 242 is slidably engaged with the upright frame 244 shown in FIG. 21.

In some embodiments, the lumbar support member 352 is slidably engaged with the first flex wing 304 and the second flex wing 306 to slide vertically upward and downward and locally adjust support along the back 350. In some embodiments, the lumbar support member 352 is slidably engaged with the first flex wing 304 and the second flex wing 306 similar to the way that the lumbar support member 202 is slidably engaged with the flex wing 204 shown in FIG. 20.

Figure 25:
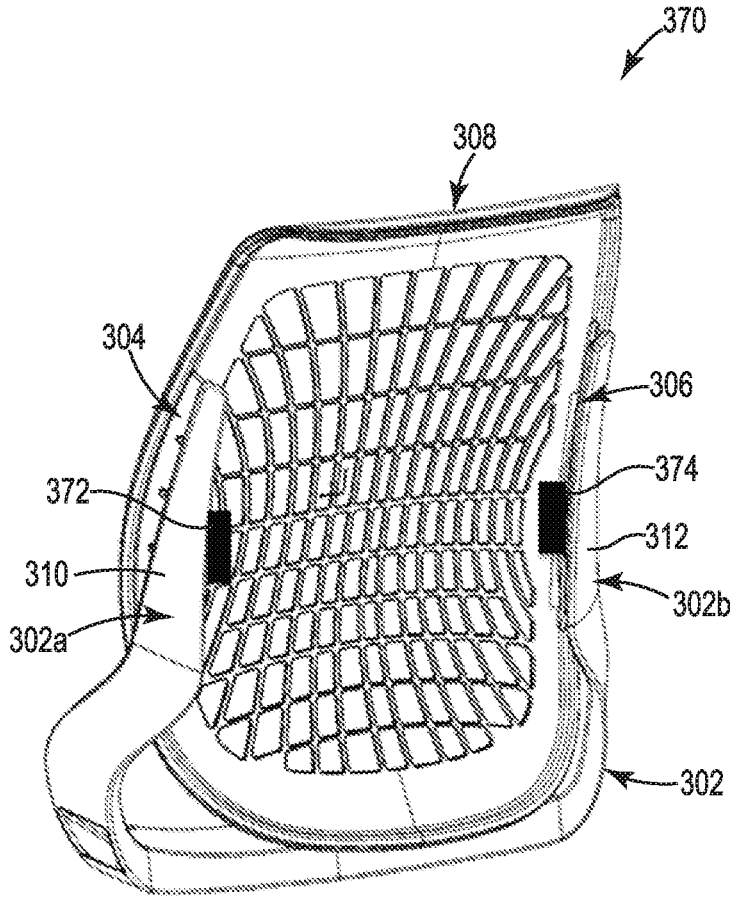
FIG. 25 is a diagram illustrating a perspective view of a back including a pair of lumbar support members, according to some embodiments.

FIG. 25 is a diagram illustrating a perspective view of a back 370 including a pair of lumbar support members 372 and 374, according to some embodiments. The back 370 is similar to the back 300, with the exception that the back 370 includes the lumbar support members 372 and 374. The back 370 includes the same or similar components as the back 300 such that like numerals point to like components and the description above of the components of the back 300 applies to the components of the back 370.

For reference, the back 370 includes the U-shaped upright frame 302, the Z-shaped first and second flex wings 304 and 306 and the back support 308. The first and second flex wings 304 and 306 are secured to the upright frame 302 and to the back support 308, which secures the back support 308 to the upright frame 302.

The lumbar support members 372 and 374 provide localized support to the back support 308, such as in the lower back region of the user. The lumbar support member 372 is slidably engaged on the first frame side 302*a* to slide vertically upward and downward and locally adjust support along the back 370. The lumbar support member 374 is slidably engaged on the second frame side 302*b* to slide vertically upward and downward and locally adjust support along the back 370.

In some embodiments, the lumbar support member 372 is slidably engaged with the first back upright 310 and the lumbar support member 374 is slidably engaged with the second back upright 312, to slide vertically upward and downward and locally adjust support along the back 370. In some embodiments, the lumbar support member 372 is slidably engaged with the first back upright 310 and the lumbar support member 374 is slidably engaged with the second back upright 312 similar to the way that the lumbar support member 152 is slidably engaged with the first back upright 66 and the second back upright 68 shown in FIGS. 13 and 14. In some embodiments, the lumbar support member 372 is slidably engaged with the first back upright 310 and the lumbar support member 374 is slidably engaged with the second back upright 312 similar to the way that the lumbar support member 242 is slidably engaged with the upright frame 244 as shown in FIG. 21.

In some embodiments, the lumbar support member 372 is slidably engaged with the first flex wing 304 and the lumbar support member 374 is slidably engaged with the second flex wing 306 to slide vertically upward and downward and locally adjust support along the back 370. In some embodiments, the lumbar support member 372 is slidably engaged with the first flex wing 304 and the lumbar support member 374 is slidably engaged with the second flex wing 306 similar to the way that the lumbar support member 202 is slidably engaged with the flex wing 204 shown in FIG. 20.

Figure 26:
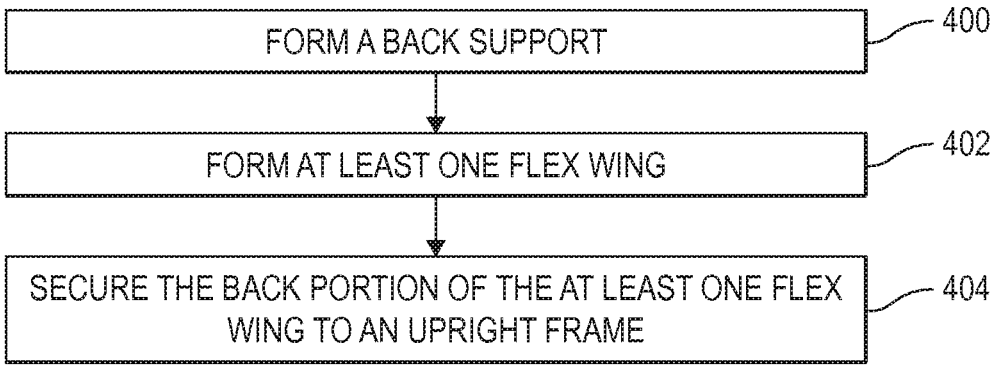
FIG. 26 is a flow chart diagram illustrating a method of making a chair back, according to some embodiments.

FIG. 26 is a flow chart diagram illustrating a method of making a chair back, such as any one of the backs 48, 170, 200, 240, 300, 350, and 370, according to some embodiments.

At 400, a back support that is substantially flexible and has a first side portion and a second side portion is formed. In some embodiments, the back support is integrally formed, i.e., as a single, monolithic piece. In some embodiments, the back support is formed of a flexible material, such as a thermoplastic. In some embodiments, the back support is formed of a flexible material, including a thermoplastic elastomer. In some embodiments, the back support is formed of a molded thermoplastic. In some embodiments, the back support is formed of a molded plastic that flexes under the weight of the user. In some embodiments, the back support includes separate pieces that are secured together, such as with one or more of adhesives, welding, fasteners, and mechanical engagement with each other.

At 402, at least one flex wing is formed, where the flex wing has a front portion that is positioned at the first side portion of the back support. The flex wing also includes a back portion and a web portion interconnecting the front portion and the back portion. Also, in some embodiments, another flex wing has a front portion that is positioned at the second side portion of the back support.

In some embodiments, the front portion, the web portion, and the back portion are integrally formed, i.e., as a single, monolithic piece. In some embodiments, the front portion, the web portion, and the back portion are integrally formed in the same manufacturing process step. In some embodiments, the front portion, the web portion, and the back portion are formed of a resilient flexible material, such as a molded plastic. In some embodiments, two or more of the front portion, the web portion, and the back portion are separate pieces attached together, such as with one or more of adhesives, welding, fasteners, and mechanical engagement with each other.

Also, in some embodiments, the flex wings and the back support are molded as a single, monolithic piece. In some embodiments the flex wings and the back support are integrally formed in the same manufacturing process step. In some embodiments, the flex wings and the back support are separate pieces attached to the back support, such as with one or more of adhesives, welding, fasteners, and mechanical engagement with the back support.

At 404, the back portion of the at least one flex wing is secured to a first frame side of an upright frame that is substantially rigid, such that the flex wing flexes in response to weight applied to the back support. Also, in some embodiments, another back portion of the other flex wing is secured to a second frame side of the upright frame, such that the flex wings flex in response to weight applied to the back support.

Figure 27:
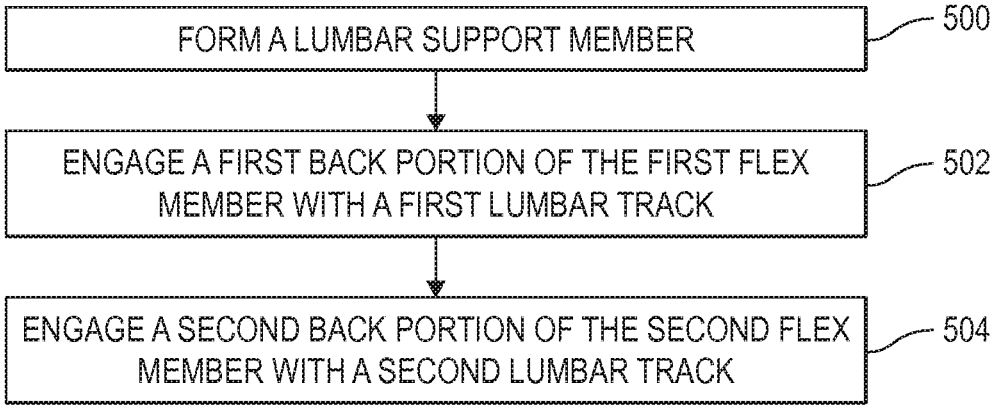
FIG. 27 is a flow chart diagram illustrating a method of making a chair that includes a lumbar support member, according to some embodiments.

FIG. 27 is a flow chart diagram illustrating a method of making a chair that includes a lumbar support member, such as the lumbar support members 152 and 162, according to some embodiments.

At 500, a lumbar support member having a first flex member and a second flex member is formed. In some embodiments, the first flex member, the second flex member, and a central crossbar member are integrally formed, i.e., as a single, monolithic piece. In some embodiments, the first flex member, the second flex member, and a central crossbar member are integrally formed in the same manufacturing process step. In some embodiments, the first flex member, the second flex member, and a central crossbar member are formed of a resilient flexible material, such as a molded plastic. In some embodiments, two or more of the first flex member, the second flex member, and a central crossbar member are separate pieces attached together, such as with one or more of adhesives, welding, fasteners, and mechanical engagement.

At 502, a first back portion of the first flex member is engaged with a first lumbar track of a back of the chair. The first back portion and the first lumbar track are engaged such that the lumbar support member can be moved up and down on the back, i.e., the lumbar support member is adjustable on the back of the chair. In some embodiments, the first back portion is engaged with the first lumbar track in a first frame side of an upright frame of the back. In some embodiments, the first back portion is engaged with the first lumbar track in a first flex wing of the back.

At 504, a second back portion of the second flex member is engaged with a second lumbar track of the back of the chair. The second back portion and the second lumbar track are engaged such that the lumbar support member can be moved up and down on the back, i.e., the lumbar support member is adjustable on the back of the chair. In some embodiments, the second back portion is engaged with the second lumbar track in a second frame side of the upright frame of the back. In some embodiments, the second back portion is engaged with the second lumbar track in a second flex wing of the back.

In some embodiments, a back support or, alternatively, a mesh material is attached to the chair to engage a first front portion of the first flex member that is connected to the first back portion by a first web portion of the first flex member and to engage a second front portion of the second flex member that is connected to the second back portion by a second web portion of the second flex member.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

We claim:

1. A lumbar support of a chair, the lumbar support comprising:

a crossbar member having a first end and a second end; and a first flex member including a first front portion coupled to the first end, a first back portion coupled to the chair, and a first web portion interconnecting the first front portion and the first back portion such that least a portion of the first web portion extends laterally outwardly of the first back portion, the first flex member further including a first flex region and a second flex region, the first flex region being defined by the first front portion and the first web portion, and the second flex region being defined by the first back portion and the first web portion wherein the crossbar member supports a back of a user and the first flex member flexes upon engagement of the crossbar member by the back of the user, and wherein the first web portion is configured to flex inwardly toward a center of the lumbar support about the second flex region during engagement of the crossbar member by the back of the user.

2. The lumbar support of claim 1, comprising a second flex member including a second front portion coupled to the second end, a second back portion coupled to the chair, and a second web portion interconnecting the second front portion and the second back portion, wherein the first flex member and the second flex member flex upon engagement of the crossbar member by the back of the user.

3. The lumbar support of claim 1, wherein the first back portion is coupled to the chair to adjust the position of the lumbar support on the back of the user.

4. The lumbar support of claim 1, wherein the crossbar member is curved to fit the contour of the back of the user.

5. The lumbar support of claim 1, wherein the crossbar member includes a first curved portion that supports the back of the user and a second curved portion that provides structural support to the first curved portion.

6. The lumbar support of claim 5, wherein the second curved portion is connected to the first curved portion by a support member that is perpendicular to the first curved portion and the second curved portion.

7. A lumbar support of a chair, the lumbar support comprising:

a crossbar member having a first end and a second end; and a first flex member including a first front portion coupled to the first end, a first back portion coupled to the chair, and a first web portion interconnecting the first front portion and the first back portion such that least a portion of the first web portion extends laterally outwardly of the first back portion, the first flex member further including a first flex region and a second flex region, the first flex region being defined by the first front portion and the first web portion, and the second flex region being defined by the first back portion and the first web portion, wherein the first front portion is configured to flex inwardly toward the first web portion about the first flex region during engagement of the crossbar member by the back of the user, and wherein the first web portion flexes inwardly toward a center of the lumbar support about the second flex region during further engagement of the crossbar member by the back of the user.

8. A lumbar support of a chair, the lumbar support comprising:

a crossbar member having a first end and a second end; and a first flex member including a first front portion coupled to the first end, a first back portion coupled to the chair, and a first web portion interconnecting the first front portion and the first back portion such that least a portion of the first web portion extends laterally outwardly of the first back portion, wherein the crossbar member supports a back of a user and the first flex member flexes upon engagement of the crossbar member by the back of the user, and wherein the first front portion is configured to fold toward the first web portion and the first web portion is configured to fold toward a center of the lumbar support during engagement of the crossbar member by the back of the user.

* * * * *